US009107020B2

(12) United States Patent
Betts-Lacroix

(10) Patent No.: US 9,107,020 B2
(45) Date of Patent: Aug. 11, 2015

(54) SYSTEM AND METHOD FOR WIRELESS MICROPHONE APPARENT POSITIONING

(75) Inventor: Jonathan N Betts-Lacroix, Belmont, CA (US)

(73) Assignee: Zetta Research and Development LLC-ForC Series, Wilmington, DE (US)

( * ) Notice: Subject to any disclaimer, the term of this patent is extended or adjusted under 35 U.S.C. 154(b) by 922 days.

(21) Appl. No.: 13/278,454

(22) Filed: Oct. 21, 2011

(65) Prior Publication Data

US 2013/0101134 A1 Apr. 25, 2013

(51) Int. Cl.

| | |
|---|---|
| ***H04R 27/00*** | (2006.01) |
| ***H04S 7/00*** | (2006.01) |
| *H04S 1/00* | (2006.01) |

(52) U.S. Cl.

CPC . *H04S 7/30* (2013.01); *H04R 27/00* (2013.01); *H04R 2420/07* (2013.01); *H04R 2460/07* (2013.01); *H04S 1/00* (2013.01); *H04S 2400/11* (2013.01); *H04S 2400/13* (2013.01); *H04S 2400/15* (2013.01)

(58) Field of Classification Search

CPC .. H04R 27/00; H04R 2420/07; H04R 29/007; H04S 2400/11; H04S 1/002; H04S 2400/13; H04S 2400/15

USPC ..... 381/85

See application file for complete search history.

(56) References Cited

U.S. PATENT DOCUMENTS

| | | | | |
|---|---|---|---|---|
| 4,215,431 | A | 7/1980 | Nady | |
| 2006/0165245 | A1 * | 7/2006 | Niehoff et al. | 381/82 |
| 2010/0045462 | A1 * | 2/2010 | Gibson | 340/572.1 |

FOREIGN PATENT DOCUMENTS

WO WO 2006125849 A1 * 11/2006

* cited by examiner

*Primary Examiner* — Joseph Saunders, Jr.
(74) *Attorney, Agent, or Firm* — Kim Rubin, Patent Agent

(57) ABSTRACT

System, method and device to provide apparent audio source position of a performer on a stage using a monophonic wireless microphone and volume modulation of left and right audio channels based on the actual position of the performer. Two audio channels are produced using a single audio input channel plus position information. Performances are enhanced by the perception of the audience that the source of the sound, such as singing, is the location of the performer on the stage. Other embodiments use additional audio channels. One embodiment uses the carrier amplitude of the wireless microphone to determine position. In another embodiment two or more wireless microphone receivers are used to improve position accuracy. The stage may be real, virtual or remote. The performance and/or audio may be live or recorded. Calibration and adjustment features are included in alternate embodiments. Constant power panning is included in one embodiment.

28 Claims, 13 Drawing Sheets

SYSTEM AND METHOD FOR WIRELESS MICROPHONE APPARENT POSITIONING

This substitute specification, in a single file as both a marked up and clean version herein, having no changes except formatting, contains no new matter, per 37 CFR 1.125 (b).

BACKGROUND OF THE INVENTION

This invention relates to the use of wireless microphones for stage performances where the position of the performer is used to create stereo audio outputs whose audio signals provide audio information to listeners as to the position of the performer.

Wireless microphones are commonly used by stage performers, including singers, musicians, actors, hosts, moderators, and speakers. A key advantage of wireless microphones is the lack of a microphone cord, thus enabling the performer to easily move around the stage, or even into the audience or other areas, including off-stage or even outside of the performance area.

Most wireless microphones are monophonic, or mono, meaning they pickup and transmit a single audio channel.

There are stereo microphones, designed primarily for used in fixed positions to pickup sounds from two more or less independent directions, usually from more than one sound source, such as a group of performers. Such stereo microphones may be used, with audio signals routed through amplifiers to stereo speakers, such that the apparent position of the performers to the audience approximately matches the actual physical position of the performers on the stage.

This apparent audio position, as perceived by the listening audience, when it matches the visual or actual position of the performers, provides a more consistent and more enjoyable listening experience. This apparent audio position of the sound source to a listener is sometimes called stereo imaging.

The use of mono wireless microphones generally prevents the presentation to a listener of an apparent matching audio position of the performer. The volume of the performer's audio signal is either set to be equal on the left and right speakers, thus creating an apparent audio position of the performer at the center of the stage, or the relative amplitudes of the signals going to the left and right speakers is unequal, as set by the sound designer or sound person for the production, creating an apparent but fixed audio position of the performer left or right of stage center. In these cases, there is no automatic means to adjust the apparent audio position of the performer as the performer moves around the stage, or moves off the stage during a performance.

SUMMARY OF THE INVENTION

This invention overcomes the specific weakness of mono wireless microphones not providing apparent audio position of the performer to match the actual position of the performer on the stage.

This invention, in one embodiment, uses traditional mono wireless microphone components, including a monaural sensor and monaural wireless transmitting channel. Two additional components are including in the invention to create an automatic means of providing apparent matching audio position of the performer. The first additional component is a position locating means that locates the position of the performer on the stage. This position locating means may locate either the performer or the microphone, although in most cases the performer and the microphone are proximal. The second additional element is a module that accepts the monaural signal from the wireless microphone and the position information as input, and then provides two or more channels of audio output to go via amplifiers to at least a left and right speaker. We refer to this module as a splitter.

In a stereo embodiment, the splitter would generally provide equal amplitude signals to the left and right channels to match a stage-center physical position of the performer. The splitter would provide a signal at 100% amplitude to the left channel and 0% amplitude to the right channel to match a far stage-left position, with a symmetric output to match a far stage-right position. Intermediate amplitudes for the left and right channel outputs are used to create matching intermediate positions of the performer for intermediate positions between stage center and stage-left or stage center and stage-right. Typically, the relative amplitude of the left and right signals is proportional to the left-right stage position of the performer, however this proportionality does not have to be linear.

There are many methods of locating a performer described in the prior art. Such methods include tracking via audio signals, tracking via light sources at the performer, tracking via radio wave emission at the performer, sonic reflection, vision recognition systems, physical sensors, and other methods. Other possible systems include the use of a GPS receiver at the performer's position, RFID tags, or using the output from a follow spot. For example, one such system could use a GPS receiver coupled with a Bluetooth transmitter. This combination exists in common, low-cost personal electronic devices that have the ability to run applications suitable for this purpose. For this invention we do not recommend any particular position locating system. Indeed, appropriate location positions systems are likely to depend both on the needs of the application and available technology.

We do describe one such position detection system that has the advantage of using already existing components of a typical wireless microphone.

In this embodiment of a position locating system the amplitude of the wireless audio signal, as broadcast by the wireless microphone is used to detect position. In a first embodiment, a single receiver may be used, where the amplitude of the received signal amplitude decreases with the distance of the microphone from the receiver. In a second and preferred embodiment two receivers are used, each located approximately stage left and stage right, and the relative amplitudes of the received signal are used to determined position, again using the fact that the signal amplitude decreases with the distance of the microphone from the receiver.

The first embodiment described above for the position detection has the unique advantage that it requires no change at all to existing wireless microphones and can be incorporated very inexpensively into the wireless receiver. Thus the same number of components with the same names and primarily the same functions as the components currently commonly in use as wireless microphone systems are used to implement this system. This feature provides for ease of deployment and rapid customer acceptance due the very small change in understanding and deployment.

The second embodiment described above for the position detection has the unique advantage of that it requires no change at all to existing wireless microphones and can be incorporated very inexpensively into a current wireless receiver design, although two receivers would be deployed in the performance arena in place of the current single receiver. Two receivers have the additional advantage that in the case of receiver failure audio is not completely lost resulting in minimum disruption of the performance in progress.

In either the first or second embodiment described above for the position detection existing circuitry in the receiver may be used to provide part of the functionally of this invention. In particular, most receivers have a circuit component called an automatic gain control, or AGC. Typically the amplitude of the radio frequency signal at the receiver varies significantly. An AGC includes a variable gain amplifier that provides a more uniform amplitude signal out even under wide variations of the amplitude of the signal in. The variable gain amplifier typically has a control input signal that indicates the desired gain of the amplifier, usually with a logarithmic relationship between the amplitude of the control signal, usually a voltage, and the gain of the amplifier.

In one embodiment of the position detection circuit the above-described existing AGC control signal is used to provide information about the amplitude of the incoming radio signal from the wireless microphone and thus the position of the performer as a distance from the receiver. Typically, some non-linear correction is needed to convert the amplitude of this control signal to a signal that linearly represents the position of the performer on the stage. Such correction may be provided with an analog circuit or with digital computation. Such non-linear correlation may not be required in all embodiments, as this AGC control signal may already be an acceptable approximate linear representation of the performer's stage position.

In an embodiment where two or more receivers are used, the receivers need to communicate by some means so that the modulator or modulators have as input the best available position information of the performer as determined by the combined information from the plurality of receivers. In the simplest embodiment, the ratio of the amplitudes of the two AGC control signals in the two receivers determines the position of the performer on the stage. Some non-linear correction may be needed for this ratio.

In a preferred embodiment, this invention includes two controls in order to improve the accuracy of the apparent audio position of the performer relative to the physical location of the performer on the stage. The first control is called, "gain." This control sets the multiplier from the received position information to the ratio of left-right outputs of the modulator. A higher gain setting moves the amount of the left or right apparent position farther for a smaller physical shift from stage center. A lower gain setting similarly move the amount of left or right apparent position smaller for a larger physical position change of the performer. A gain setting of zero would place the apparent audio position of the performer at stage center no matter where the performer was actually located. A second desirable control is called, "offset." This control changes the apparent audio position of the performer left or right of the performer's actual position. This control is particularly useful if the two receivers, for a two-receiver embodiment, are not located symmetrically at the sides of the stage. Ideally, The combination of the gain and offset controls is typically used in order to accurately recreate an apparent audio position of the performer that consistently corresponds to the performer's actual position on the stage.

In an ideal embodiment there are one, two, or three, "calibration buttons." In a single calibration button embodiment, one button is used to indicate that the performer is in a preset location. In one embodiment the button is used to indicate that the performer is now at stage center. This button then sets the equal-output point of the modulator, for a stereo embodiment of the modulator. In a two-button embodiment one button sets the "stage-left" position and the second button sets the "stage-right" position of the performer. In the three calibration button embodiment, one button sets stage center, a second button sets stage left, and a third button sets the stage right position.

The use of calibration buttons in the embodiment may provide easier setup and may provide more accurate apparent audio positioning. The use of calibration buttons in the embodiment may eliminate the need or use of manual gain and offset controls, although such manual controls may still be desirable.

The calibration buttons may be located on one or more receivers. Such an embodiment provides the fewest physical components in the complete system. Calibration buttons located on the left and right receivers, in a stereo embodiment, allow the performer himself or herself, typically, to perform a two-button calibration without the assistance of a second person.

In yet another embodiment, one or more calibration buttons may be placed on the wireless microphone. One means to communicate the activation of calibration buttons placed on the wireless microphone is to discontinue the radio broadcast from the wireless microphone for a preset time period, where the length of time for the time period corresponds to the calibration button activated. For example, a 100 milliseconds broadcast discontinuity corresponds to a first button, 200 milliseconds to a second button, and 300 milliseconds to a third button. In yet another embodiment placing calibration buttons on the microphone uses the audio channel itself to provide the button activation signal. Such a signal could be within the human audible frequency range, or outside the human audible frequency range.

For systems that involve more than two channels, the embodiments described herein are scaled up in manner understood by one trained in the art. Determining the position and relative outputs for two channels is typically linear, or close to linear, including gain and offset adjustments. Determining the position and relative output for more than two channels is typically more complex. Position may be determined by well-known triangulation techniques, by Gaussian techniques, by most-likely calculations, by calibration points, by manual entry of points, or by automatic memorization of a performer's movement pattern. Recreating correct apparent audio position for two or three dimensions of performer movement depends heavily on speaker placement. Persons trained in the art will recognize the methods of determining and creating apparent audio position and will be qualified to setup, adjust and calibrate such a system that uses more than two channels.

We have discussed this invention so far in terms of a live performance with live listeners in the audience of the performance. However, all aspects of this invention and its various embodiments apply equally to broadcast performances, such as via wire, cable, radio, television, satellite or the web, and also to performance recordings of all kinds. Thus, the perceived audio position of the performer may be live in person, live at a distant location, or later in time.

Although we have talked about performers on a stage, this invention is also applicable to other applications, such as police, fire or safety workers. Workers on a bridge, in a mine, on platforms, on a roadway, at a fire, in a police action, or in other working environments may use a wireless microphone, a radio, or a phone to communicate with other workers. There is an obvious advantage for the other workers to have an immediate sense of where the speaker is located by listening to the apparent source of the voice.

In one embodiment the position information is derived from the amplitude of the carrier signal of a wireless microphone. In another embodiment the position information comes from an RF time-of-flight device, ideally from a transmitter worn by the performer to one or more receivers located in the stage area. RF spread-spectrum technology may be used. In another embodiment the position information comes from an optical time-of-flight device, ideally from one or more transmitters worn by the performer to a plurality of receivers located in the stage area. In another embodiment, the position information comes from audio delay, cycle count and/or phase information from an audio, sub-audio, or ultrasonic transmitter, ideally worn by the performer to one or more audio receivers located in the stage area. It is particularly valuable, in some applications, to have the transmitter located in or with the wireless microphone. However, for some applications, such as those where a wireless microphone is not used, such as in ballet, ice-skating, and sports, the performer may wear a transmitter. In other embodiments, however, the position information of microphone or performer could come from other sources. For example, an observer could have an input device, such as a joystick, which the observer adjusts to provide a position signal to this invention based on the observer's observed position of a performer. This manual input approach may be appropriate when other, more automated position detection is impractical or not economical. For example, if the performer is an animal or is under water. One automatic means is to use a vision-based system which tracks the performer based on a video signal. Such tracking systems are widely used and known in the art. Another automatic means is to use an optical system with an optical transmitter on the performer. Another automatic means is to use a device containing both a position sensor, such as a GPS receiver, differential GPS, or other detector plus a wireless communication means such as Bluetooth, Wi-Fi, cellular data, or other communication means. This position-sensing device then detects and transmits the location of the performer, which is then used to determine the relative position of the performer on the stage. Such position sensing means may be either active or passive systems. Yet another automatic means is to detect the position of the performer from the mechanical position of a follow-spot. By monitoring the two-axis of motion of the follow spot, plus the use of basic trigonometry, it is simple to calculate the actual position of the follow-spot upon a surface. A cable or wireless communication may be used to communicate the position information from the follow-spot to the device, system or method of this invention. Even if the follow-spot has a human operator, no additional operator or manual input is required for this invention to be operational.

Two or even three dimensions of position information may be used with this invention. Additional speakers channels may be used, but are not required. For example, consider a deep stage. As the performer moves to the rear of the stage, the amplitude to both the left and right channels may be reduced, thus provide the effect to the listener that the performer is farther away. As another example, consider an ice skater on a large rink. The skater may be performing to a recording, in this example. By the use of multiple speakers, it is possible by using this invention to create an effect for the audience that the recorded sound, such as a singing voice, is coming from the ice skater. A similar example is an athlete on a large field, track or venue. A similar example is a racecar driver on a track. The sound source could be from the source in real-time, such as a roving singer, and acrobat or clown, or an animal. Or, the sound could be pre-recorded. For example, recorded sounds of a dog yelping could be played, using this invention to track one or more dogs around a track, where the audience hears the yelping as if coming from one or more running dogs.

An example of a three dimensional application is a circus. Performers may be high in the tent, or in the audience. By providing three dimensions of position information and a sufficient number of speakers the people in the audience can be given the impression that the sound is coming from anywhere within the 3D venue, or even outside the venue.

DETAILED DESCRIPTION

Figure 1:
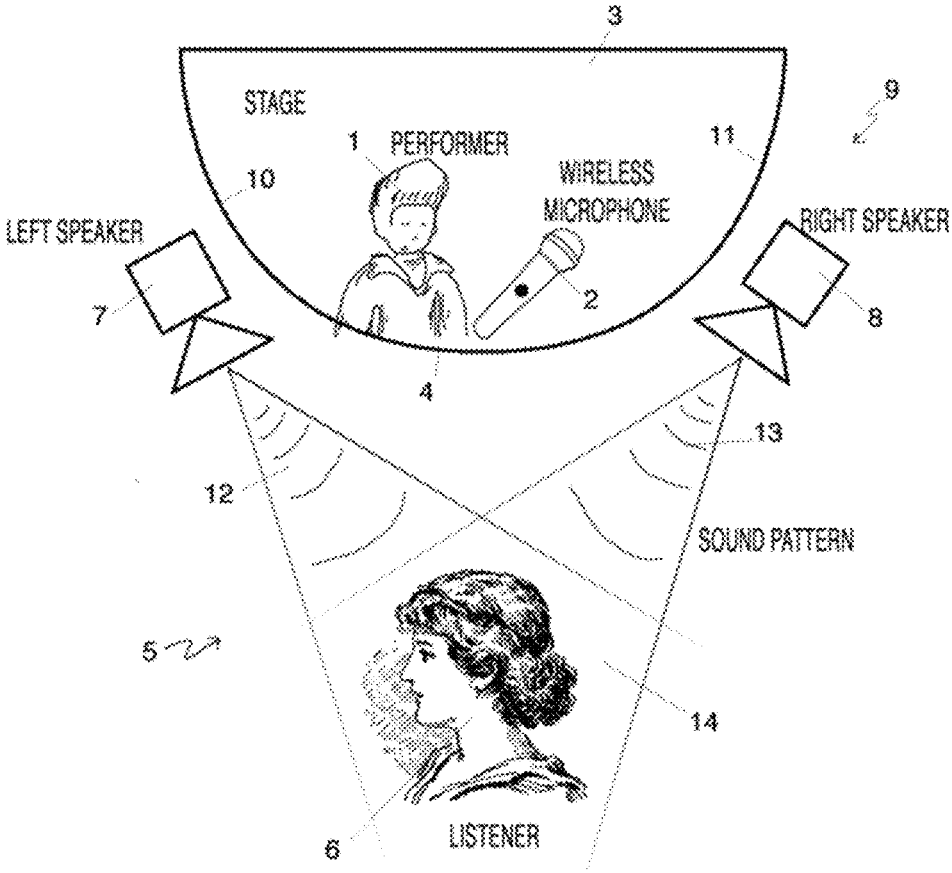
FIG. 1 shows an overhead view of a typical audio stage performance arrangement, including the stage, a performer, speakers, and the audience.

Creating an apparent position of a sound source between two speakers is a known problem in the art. One term for this is "stereo imaging," often in the context of producing the "correct" apparent position of the sound source, where correct means the desired position. There are multiple algorithms for starting with a monaural source and allocating a percentage of the amplitude of that source to the two speakers, which for convenience in this section of the discussion we also call the left speaker and right speaker. One known algorithm is called, "constant power panning," where the term panning refers to moving the apparent source from the left to the right speaker or vice versa. Constant power refers to the goal of having the sum or the power in the left speaker plus the power in the right speaker a constant value, relative to a fixed amplitude source and variable panning. Implementing constant power panning typically uses the algorithm where the voltage amplitude to the left channel is the square root of the desired position, where full left is equal to zero and full right is equal to one, and one represents 100% of the desired maximum voltage. The voltage the right channel is the square root of one minus the desired position, now expressed in the range of one down to zero. The power to a fixed impedance speaker is the square of the input voltage.

This particular algorithm for implementing constant power panning is shown below in Table 1. Other algorithms for creating an apparent position of a sound source between two speakers are known and may be used. Some algorithms incorporate a logarithmic relationship between position and voltage. Others use transcendental functions. Others use a triangulation approach involving the apparent positions and the listener position. Hybrid algorithms may be used. Empirically determined relationships may also be used. Implementation of the chosen algorithm may be implemented with analog electronics, digital computation. Implementation may use lookup tables.

The necessary amplitude computation, generation or lookup does not need to be particularly good in order to create an effective apparent position for a listener. Errors of 30% of amplitude may be adequate. Errors of 10% of less, for many applications will produce an effective result. Higher accuracy will, in some cases, produce a higher quality effective imaging. Accuracy worse than 30% will still produce some desired effect. Thus, effective implementation of this invention does not necessarily require any correction or linearization of a non-linear position input, such as an AGC control voltage, nor requires constant power panning implementation.

It is commonly regarded that an apparent doubling of sound volume requires approximately 10 dB more speaker power. Sound energy declines approximately with the square of the distance between the speaker and the listener. However, this approximation may be off due to the three-dimensional, spherical dispersion of sound energy from the speaker and may be off due to reflection of sound energy within the performance arena. There are also triangulation effects because frequently the listener is not a constant distance from both the speakers and the desired apparent position. As one trained in the art will appreciate, there are numerous ways to correct for or improve upon stereo imaging taking one or more of these site specific, application specific, sound type specific, or personal preferences into account.

An implementation may include additional features. For example, it may be desirable to average, filter or limit the speed of change of the position input signal. Variations in RF signal amplitude, and other factors may cause artifacts in the reported position of the performer or microphone. These artifacts may be reduced or mitigated by such averaging, filtering or speed of change limiting.

FIG. 1 shows an example of one embodiment of the invention, in use in an exemplary environment 9. A performer 1 is using a cordless microphone 2 is on a stage 3 to provide audio to one or more listeners 6 located in a listening area 5. The stage 3 includes a front 4, a left boundary 10 and a right boundary 11. The three boundaries, 4, 10, 11, may be specifically defined, such as the physical edge of an elevated stage, or they may be only approximate areas. Note that for convenience in describing this invention we often use "left" and "right" to designate two distinct areas, speakers or channels, but no specific locations, orientation or meaning is attached to these to terms. In the claims, we typically refer to a "first" and a "second" noun, where for convenience the reader may often prefer to substitute left for first and right for second, although again, no specific relationship is required. In some embodiments there are more than two channels. The use of left and right, or first and second, is in no way meant to limit the number of channels for this invention. Note also the industry term, "stage left" refers to the performer's left as he or she faces the audience, and similarly for "stage right." For convenience and consistency in this patent, "left" and "right" will refer to the positions as shown in FIG. 1 and reference the left and right side of the performing area as seen by a listener facing the stage, as is industry traditional for the definition of left and right channels in a stereo audio system. FIG. 1 shows the left speaker 7 located proximal to the left side 10 of the stage. This speaker 7 may be above or below, or on the stage proper or off the stage proper, but should, in a preferred embodiment, be located proximal to the corresponding side of the stage. Similarly we see right speaker 8 located proximal to the associated right side of the stage 11.

The left 7 and right 8 speakers provide audio information in two corresponding sound patterns 12 and 13. These sound patterns overlap in an idealized listening area traditionally located approximately equidistant from the two speakers. This listening area is sometimes called the "sweet spot" by those trained in the art. Listener 6 is shown in the preferred sound pattern overlap, which has the best "stereo imaging," to use a common term in the art.

The purpose of stereo imaging is to provide the listener 6, or any listener in the listening area 5, which may be remote in space or time from the performance itself, with a sense that the location of the performer 1 on the stage 3 is close to actual location of the performer on the stage. For a two channel system, this stereo imaging effect is limited to a line between the left speaker 7 and the right speaker 8, which corresponds in general to the available positions on the stage for the performer between the two stage boundaries 10 and 11 respectively.

In the prior art, the use of a single channel wireless microphone 2 provided only a single channel of audio. This channel has normally, in the prior art, been mixed for equal volume to both the left and right channels, providing a stereo imaging effect for the listener that the performer is always in the center of the stage, no matter where the performer is actually on the stage. Although a sound designer or other person trained in the art may choose to mix the single channel of audio from the wireless microphone unequally to the left and right channels, thus placing via stereo imaging the effect of having the performer located some other place on the stage other than the center of the stage, this location is still fixed, providing no realistic sense to the listener as the performer moves around on the stage. Alternatively, in the prior art, a sound person or other operator could dynamically change the mix to affect the stereo imaging, but this effect would be done manually, not automatically.

This invention uses position information about the performer or the wireless microphone to provide an appropriate and effective stereo imaging effect while still using only a single audio channel from the wireless microphone, or a single channel of audio from another source. For example, a performer could be live, but the audio could be recorded. By using the position information from the live performer the effect of a live performance, rather than a recorded performance is superior.

Figure 2:
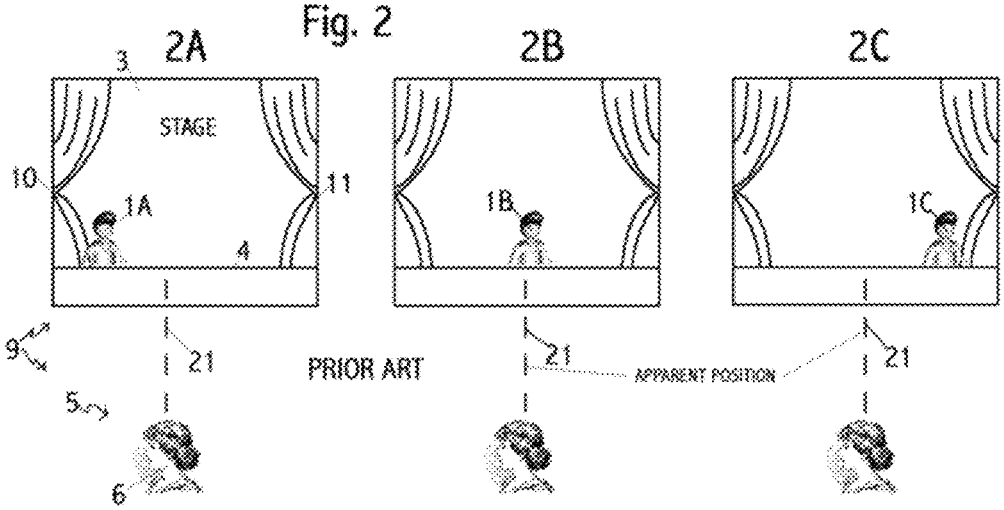
FIGS. 2A, B and C shows the physical and apparent audio positions of a performer using the prior art.
Figure 3:
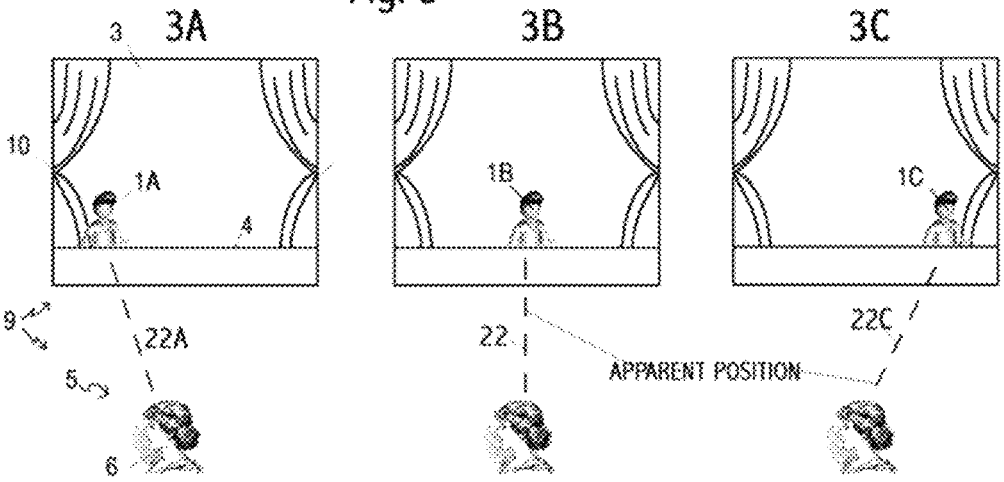
FIGS. 3A, B and C shows the physical and apparent audio positions of a performer using this invention.

FIG. 2 and FIG. 3 show the different between the prior art and the use of this invention. The performing arena 9 includes both the stage area 3 and the listening area 5. The performer is typically located somewhere on the stage 4, although it is not necessary for the performer or a wireless microphone to be on the stage 4 or even in the stage area 3. As the performer moves from the left side of the stage 10 in FIG. 2A, passing the center of the stage in FIG. 2B to the right side of the stage 11 in FIG. 2C the listener 6 for all three positions perceives that the effective source of the audio 21 is from the center of the stage.

FIG. 3 shows the how the apparent position of the performer, the automatic stereo imaging effect created by this invention in one embodiment, follows the actual position of the performer. As the performer moves across the stage 4 from the left side in FIG. 3A through the center of the stage shown in FIG. 3B to the right side of the stage in FIG. 3C the apparent position of the performer as sensed by a listener 6 is from the left 22A in FIG. 3A; from the center of the stage 22B in FIG. 3B; and from the right 22C in FIG. 3C.

Figure 4:
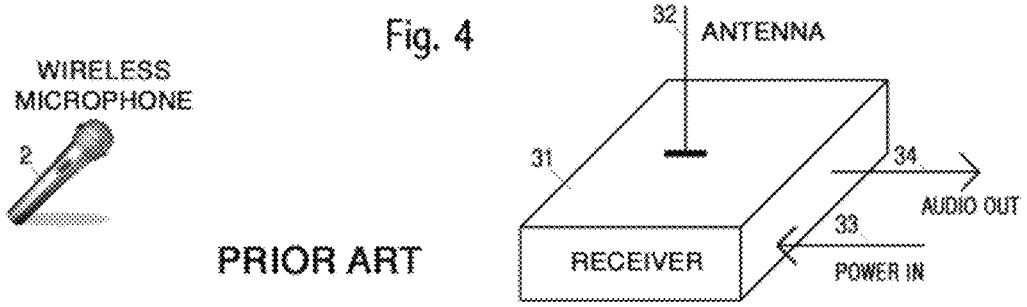
FIG. 4 shows the prior art for a wireless microphone.

FIG. 4 shows the prior art for a wireless microphone. The wireless microphone 2 transmits a single channel audio signal on a carrier-wave, which is picked up by the antenna 32, demodulated to produce the original audio signal, which is then output on audio output 34. The receiver typically accepts power 33 from an external source, while the microphone uses batteries for power, however the receiver may alternatively be powered from batteries.

Figure 5:
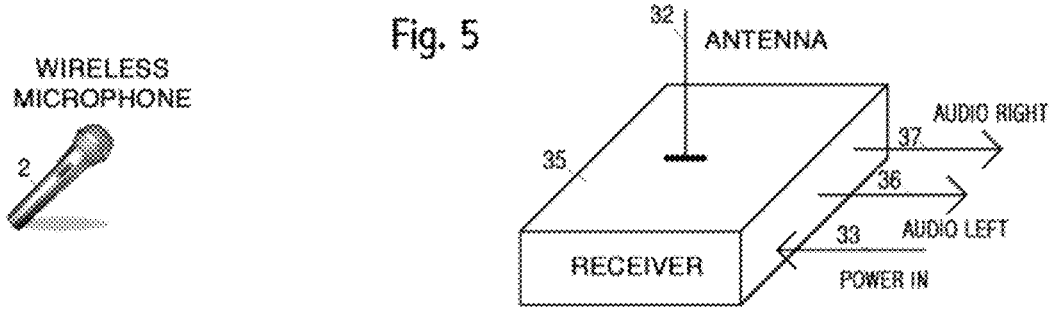
PRIOR ART Fig. 5
FIG. 5 shows the arrangement of components in one embodiment using one receiver.

FIG. 5 shows one embodiment of the invention. The wireless microphone 2 is unchanged from the wireless microphone 2 shown in FIG. 4. However, in different embodiments the wireless microphone may have additional features, such as one or more position calibrating buttons. The receiver 35 has two audio outputs: an audio left channel signal 36 and an audio right channel signal 37. The receiver 35, in one embodiment, may use the same antenna 32 and the same demodulation system as the prior art receiver shown in FIG. 4. Other embodiments may have additional output channels. Note that all audio signals may be analog signals or digital signals. Audio outputs may be copper or fiber.

Figure 6:
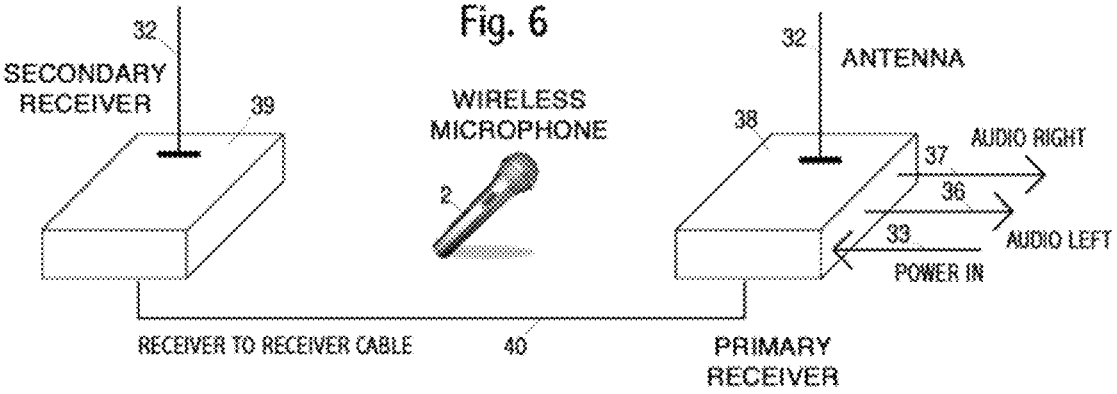
FIG. 6 shows the arrangement of components in another embodiment, using two receivers.

FIG. 6 shows yet another embodiment of the invention, using two receivers, a primary receiver 38 and a secondary receiver 39. The wireless microphone 2 is unchanged from the wireless microphone 2 shown in FIG. 4. However, in different embodiments the wireless microphone may have additional features, such as one or more position calibrating buttons. One or both receivers 38 and 39 demodulate a one channel audio signal. The receivers 38 and 39, in one embodiment, may each use the same or similar antennas 32 and the same demodulation system as the prior art receiver shown in FIG. 4. The primary receiver 38 has two audio outputs: an audio left channel signal 36 and an audio right channel signal 37. In a different embodiment the primary receiver 38 provides one such audio output 36 or 37 while the secondary receiver 39 provides the second audio output 37 or 36. In another embodiment, both audio outputs 36 and 37 are provided only by the secondary receiver 39. In another embodiment, both receivers provide both audio outputs. Other embodiments may have additional output channels. Other embodiments may use addition receivers beyond the primary and secondary receivers 38 and 39 shown in FIG. 6. The receiver typically accepts power 33 from an external source, while the microphone uses batteries for power, however the receiver may alternatively be powered from batteries. In the embodiment shown in FIG. 6 the primary receiver 38 provides power to the secondary receiver 39 via a cable 40. However, in a different embodiment the secondary receiver 39 may receiver power from a different source. Typically, in one embodiment, the two receivers 38 and 39 are connected via a cable 40. However, this cable is not required, as the receivers may communicate via other means. Note that all audio signals may be analog signals or digital signals. Audio outputs may physically be copper or fiber, or retransmitted wirelessly, such as via Bluetooth or via 802.11.

Figure 7:
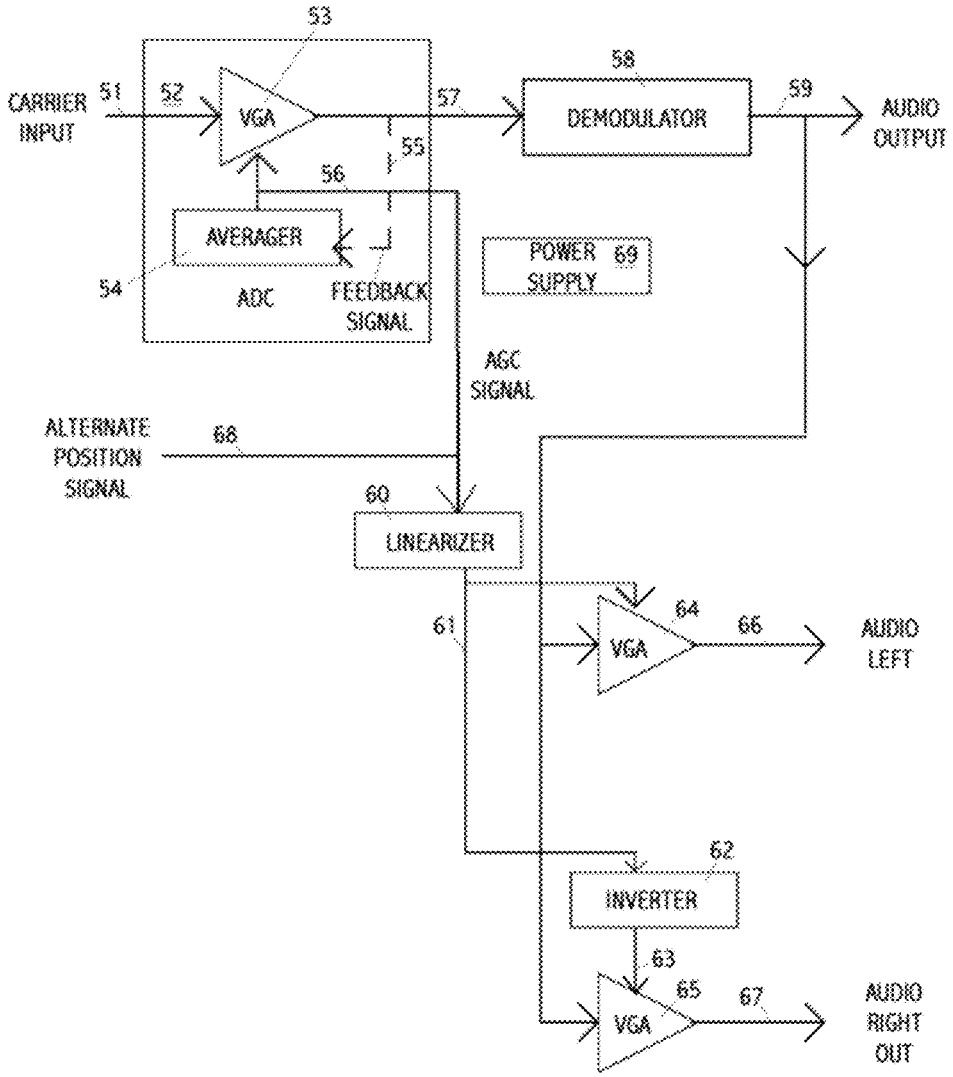
FIG. 7 shows the arrangement of components in another embodiment, using a different position-sensing device.

FIG. 7 shows a circuit that may be used in one embodiment of this invention. The ADC 52 and the demodulator 58 together produce one channel audio output 59. 52, 58 and 59 are prior art. The output 56 from the AGC is not prior art. Internally with the ADC 52, in a typical implementation the carrier input 51, which may be radio frequency (RF), goes to a variable gain amplifier (VGA) 53. The VGA 53 is controlled via a feedback signal 55 comprising the signal amplitude of the VGA output. This carrier output amplitude signal 55 is averaged by averager 54. The time constant of this averager 54 may vary widely. The output of the averager 56 is used to control the gain of the VGA. In this way, the AGC maintains a roughly constant amplitude output 57 over a wide range of input carrier 51 amplitude.

The amplitude of the carrier input 51 depends, upon other things, the distance of the wireless microphone from the receiver. This amplitude decreases, typically, approximately as the square of the distance. However, there may be significant variations, either higher or lower, from this relationship. Nonetheless, except in pathological cases the amplitude of the carrier input 51 decreases with distance. Thus, the ADC control signal 56 comprises some information about the distance between the wireless microphone and the receiver. In one embodiment, usable distance information is extracted from this signal. Note that implementations of ADCs vary widely. The signals involved may vary significantly in amplitude, range, offsets and sign. They may be voltages or currents. They may be analog or digital signals.

Continuing with details shown in FIG. 7, the ADC control signal 56 passes through a linearizer 60 to produce a VGA control signal 61. The linearizer is used to shape the amplitude profile of the ADC control signal 56 to make it suitable for use by the two variable gain amplifiers (VGAs) 64 and 65. The linearizer may not be necessary in some embodiments, either because the ADC control signal 56 is already suitable for use signal 61, or because the necessary accuracy of the stereo imaging effect of this invention is suitable without linearizing, or because the VGA amplifiers 64 and 65 themselves provide any necessary amplitude shaping, or for other reasons. We assume in this embodiment that the VGA amplifiers 64 and 65 produce a linear change input, either voltage or power with a linear change in the respective control signals 61 and 63. Any non-linearity by the VGA amplifiers 64 and 65 with respect to the control signal merely requires a different shaping function provided by the linearizer 60, as one trained in the art will appreciate. Thus, we point out, that the linearizer 60 may in fact not produce an output signal 61 that varies linear with the position of the wireless microphone, but does in fact produce an amplitude-shaped output 61 appropriate to the two VGA amplifiers 64 and 65.

Continuing with details shown in FIG. 7, the traditional one channel audio output 59 from the demodulator is passed through a pair of variable gain amplifiers (VGAs) 66 and 67 to produce the left and right channel audio signals 66 and 67. The VGAs produce output amplitudes that are complementary and are controlled by the effective position input signal 61. Since the outputs of the two VGAs 66 and 67 must be complementary, meaning as the amplitude of one increases that the amplitude of the other channel decreases, an inverter 62 is used to invert the position signal 61 into a complementary position signal 63. Note that the term, "inverter," here, refers to the logical function of the range of the position signals 61 and 63. No specific voltage function is implied by the term, "inverter," but rather the logical function of inverting the range of the input signal 56 as it varies to represent from a first position to a second position into an output signal 61 that then varies respectively to represent from the second position the first position.

A power supply 69 of any form or forms provides power to the components of this circuit.

Note that the elements 60, 64, 65 and the signals 59, 61, 63, 66, and 67 may be used in an alternative embodiment using an alternative position input signal 68 that does not come from an internal ADC within one receiver.

Note that as before, the designations, "left" and "right" are arbitrary. Note that more than two audio channels may be output if more than a single scalar position input is available. Note that as before, any or all or any combination of signals may be analog or digital.

The elements of the circuitry shown in FIG. 7 may, in a typical embodiment, be entirely inside of a receiver. However, no such restriction is required or implied. Indeed, in a distributed environment, including a distributed digital environment, some of the components may be located remote from each other, such as a mixer, an amplifier, a specialized component, a programmable component, or other audio component.

Note that we do not show in this circuit or in other circuits minor, typical, common and required elements for implementation or irrelevant features of analog electronics or signal processing, including amplification, buffering, range shifting, offsets, filtering, range limiting, selection, multiplexing, or decimation or supersampling in the case of digital signals. Such elements are well understood by those trained in the art and are not relevant to the logical functioning of the circuitry of this invention.

Note also that the audio outputs 66 and 67 may be voltages, currents, power, or any other form representing one channel of audio information each, including both analog and digital. These audio outputs 66 and 67 may be multiplexed or encoded, and thus are not necessarily on distinct wires.

Figure 8:
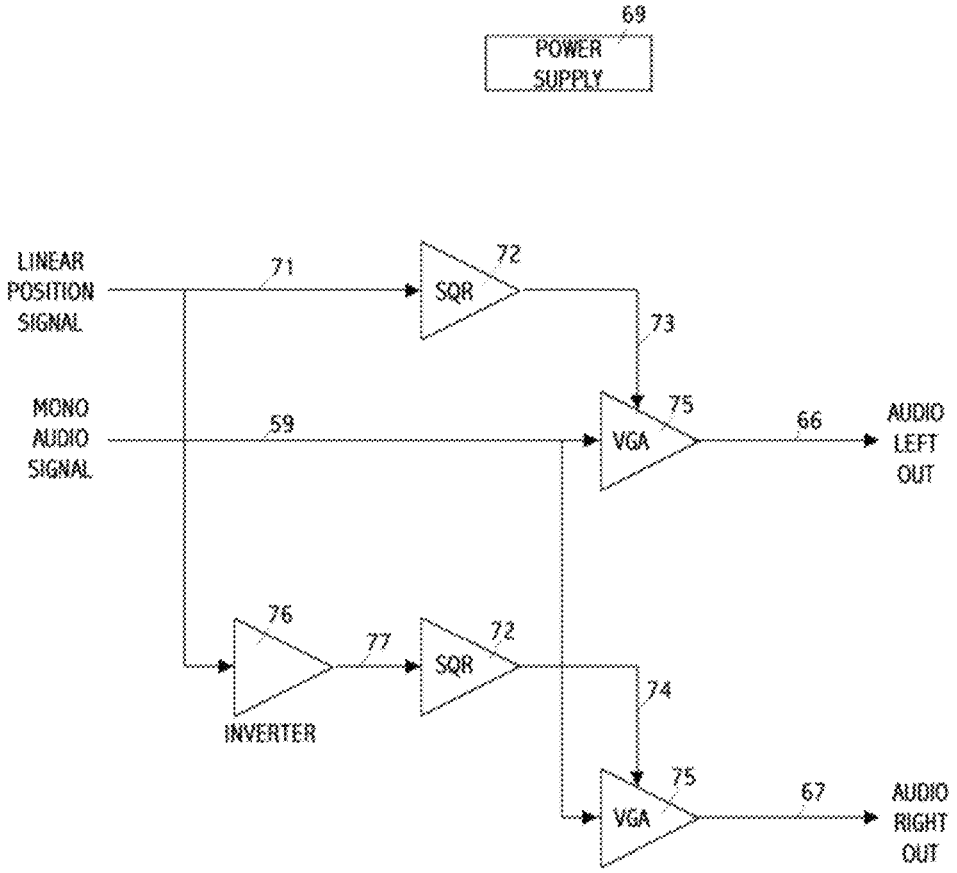
FIG. 8 shows circuit details for one embodiment, using one receiver.

FIG. 8 shows circuitry that may be used in one embodiment of this invention to provide "constant power panning," which a term of the art meaning that as the real or apparent position of a sound source moves from a first position to a second position, that the sum of power input to or output from two speakers or sets of speakers representing the first position and second position respectively is approximately a constant. Thus, to a listener, the total volume of sound is substantially unchanged as the apparent source of the sound moves. This constant power panning is generally a desired feature when a sound source moves during a performance. In a typical embodiment, individual audio channels are a voltage modulated only at audio frequencies and AC coupled. In a typical digital environment, a scalar. changing at an appropriate sampling frequency, is used to represent the equivalent instantaneous voltage as would exist in a comparable analog system. The power output of a typical speaker is approximately the square of the input voltage amplitude because the speaker has approximately constant impedance. For example, doubling the input voltage to the speaker produces four times the audio power from the speaker, approximately.

To produce constant power panning, where the power is the square of the output voltage amplitudes of the channels, requires taking the square root of the voltage before allocating that fixed amplitude to the two channels. One such embodiment of one such circuit is shown in FIG. 8

Table 1 shows in tabular form the relationship between voltage and power for an exemplary two channels. The second row of this table shows the respective signal points in the circuit of FIG. 8. Here, zero to 100% represents the available range between a first point and a second point. Zero to 100% also represents the full range of available voltage for a signal or full range of power for the output power of a speaker. The last column in Table 1 shows how this circuit accomplishes constant power panning.

Continuing with the circuit in FIG. 8, the linear input position 71 is inverted by inverter 76, where, as above, this inverter represents the logical inversion of the position, not the implementation of any specific numerical function. The output of the inverter 76 is signal 77, which can also be seen numerically in one exemplary embodiment in Table 1. The first and third columns of Table 1 show the operation of the inverter 76. These two linear positions 71 and 77 are converted to square roots by the square root components 72, producing the square root of the position signals 73 and 74 respectively, which are also shown in two labeled columns in Table 1. These two signals 73 and 74 are used to control linear variable gain amplifiers (VGAs) 75. These two VGA amplifiers take the signal channel audio signal 59 and create the left and right channel audio outputs, whose amplitudes are responsive to the control signals for the VGAs signals 73 and 74.

Note that as before, the designations, "left" and "right" are arbitrary. Note that more than two audio channels may be output if more than a single scalar position input is available. Note that as before, any or all or any combination of signals may be analog or digital. Note that the ranges of signals shown in Table 1 are exemplary only and arbitrary.

For some embodiments the use of a square root function in the circuit is neither required nor desired. Constant power panning may be achieved in other ways. Or, constant power panning may not be desired at all. This square root function may not be shown for all circuits or examples herein. The square root function may be included in other modules, such as within a VGA module, or within an amplitude-shaping module. Note also that implementation of a square root module may not need to be precise. For example, use of logarithmic amplifier may, for some embodiments or some applications, provide a suitable implementation of a square root function over the desired signal range.

TABLE 1

Relationship Between Position, Voltage And Power.

| Linear Position sig 71 | Square-Root of Position sig 73 | Reverse Position sig 77 | Square-Root Reverse Position sig 74 | First Speaker Power | Second Speaker Power | Sum of Speaker Powers |
|---|---|---|---|---|---|---|
| 0% | 0% | 100% | 100% | 0% | 100% | 100% |
| 3% | 18% | 97% | 98% | 3% | 97% | 100% |
| 6% | 25% | 94% | 97% | 6% | 94% | 100% |
| 9% | 31% | 91% | 95% | 9% | 91% | 100% |
| 13% | 35% | 88% | 94% | 13% | 88% | 100% |
| 16% | 40% | 84% | 92% | 16% | 84% | 100% |
| 19% | 43% | 81% | 90% | 19% | 81% | 100% |
| 22% | 47% | 78% | 88% | 22% | 78% | 100% |
| 25% | 50% | 75% | 87% | 25% | 75% | 100% |
| 28% | 53% | 72% | 85% | 28% | 72% | 100% |
| 31% | 56% | 69% | 83% | 31% | 69% | 100% |
| 34% | 59% | 66% | 81% | 34% | 66% | 100% |
| 38% | 61% | 63% | 79% | 38% | 63% | 100% |
| 41% | 64% | 59% | 77% | 41% | 59% | 100% |
| 44% | 66% | 56% | 75% | 44% | 56% | 100% |
| 47% | 68% | 53% | 73% | 47% | 53% | 100% |
| 50% | 71% | 50% | 71% | 50% | 50% | 100% |
| 53% | 73% | 47% | 68% | 53% | 47% | 100% |
| 56% | 75% | 44% | 66% | 56% | 44% | 100% |
| 59% | 77% | 41% | 64% | 59% | 41% | 100% |
| 63% | 79% | 38% | 61% | 63% | 38% | 100% |
| 66% | 81% | 34% | 59% | 66% | 34% | 100% |
| 69% | 83% | 31% | 56% | 69% | 31% | 100% |
| 72% | 85% | 28% | 53% | 72% | 28% | 100% |
| 75% | 87% | 25% | 50% | 75% | 25% | 100% |
| 78% | 88% | 22% | 47% | 78% | 22% | 100% |
| 81% | 90% | 19% | 43% | 81% | 19% | 100% |
| 84% | 92% | 16% | 40% | 84% | 16% | 100% |
| 88% | 94% | 13% | 35% | 88% | 13% | 100% |
| 91% | 95% | 9% | 31% | 91% | 9% | 100% |
| 94% | 97% | 6% | 25% | 94% | 6% | 100% |
| 97% | 98% | 3% | 18% | 97% | 3% | 100% |
| 100% | 100% | 0% | 0% | 100% | 0% | 100% |

Figure 9:
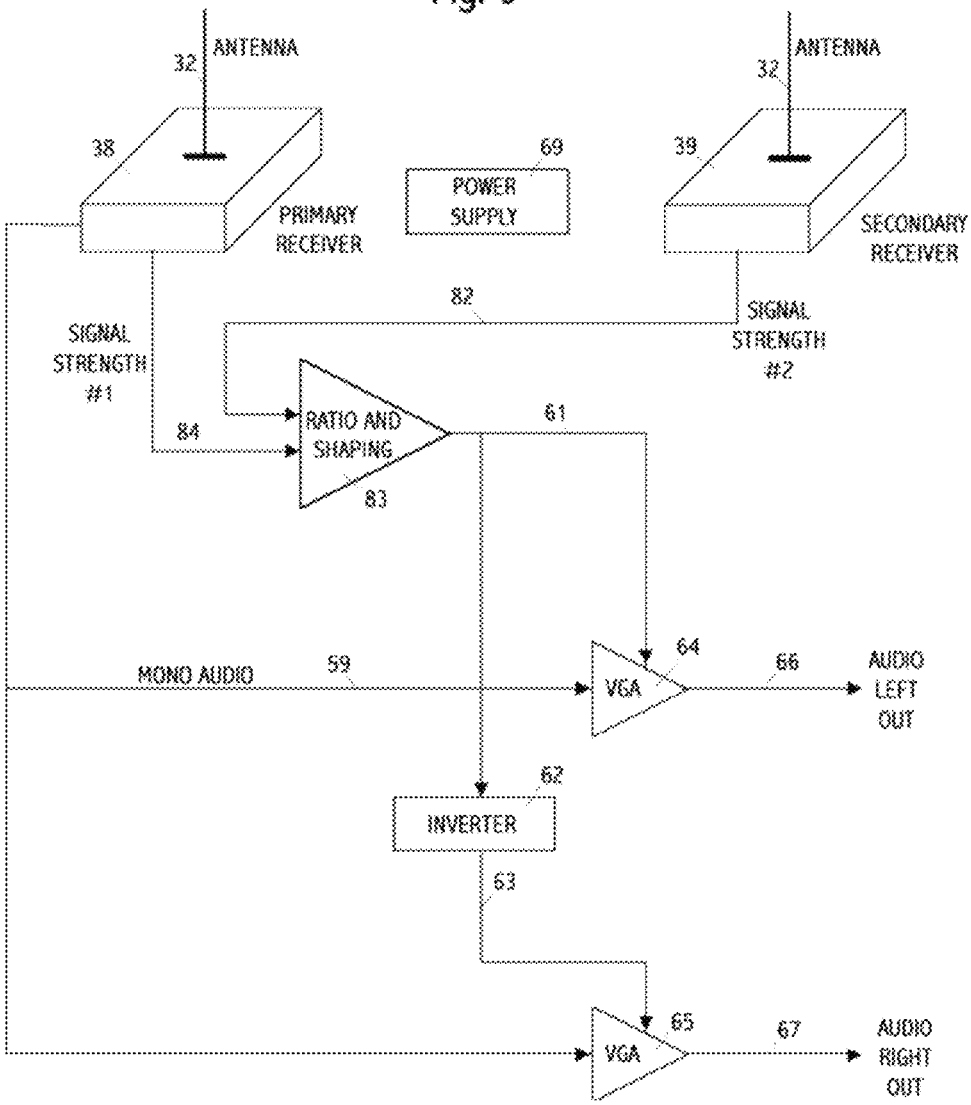
FIG. 9 shows circuit details for another embodiment, using two receivers.

FIG. 9 shows an embodiment of the invention that uses two wireless microphone receivers, a primary receiver 39 and a secondary receiver 39. A key feature of this embodiment is the use of signal strength signals from both receivers, rather than just from a single receiver as shown in FIG. 7. Various elements of the receivers are not shown in this figure as they have been previously described. Each receiver has an antenna 32 that receives the carrier signal from the wireless microphone. In a typical application one receiver would be placed near a first position near one side of a performance area and the second receiver placed near a second position near the other side of a performance area. As described previously, the carrier signal amplitude from the wireless microphone tends to decrease as the square of the distance from the wireless microphone to the receiver. This means that if the wireless microphone is close to the receiver that there is likely to be good variation in the amplitude of the carrier signal as a function of distance; yet, if the wireless microphone is far from the receiver there may be minimal variation in the amplitude of the carrier signal as the distance changes. Two receivers, appropriately placed, improves this situation. Not only is the wireless microphone likely to be reasonably close to one of the two receivers, but also by considering both carrier receive amplitudes from both receivers, various effects on the carrier signal amplitude that affect both receivers equally, such as the battery voltage of the batteries in the wireless microphone, may be cancelled. Thus, a two-receiver design is superior for consistent and accurate detection of distance, if the carrier signal amplitude is used to create the position information signal.

FIG. 9 does not show any possible communication cable or other means connecting the primary 38 and secondary 39 receivers, as this is discussed elsewhere. Each of the two receivers produces a carrier signal amplitude signal, 81 and 82 respectively. These two signals are compared and combined in the ratio and shaping module 83. In the simplest case, the ratio of the two amplitudes may be used. As is discussed elsewhere, in some embodiments it is desirable to use input or output shaping in order to produce an output signal 61 that sufficiently reflects the position of the wireless microphone between the primary and secondary receivers.

Note that it is not necessary to have the two receivers precisely at the first and second locations that are desired to use as endpoints for the generated or perceived stereo imaging effect. As discussed elsewhere, gain and offset controls, as well as calibration and other mechanisms and adjustments may be used to compensate of variations in the locations of the primary and secondary receivers relative to the desired first and second positions.

Figure 10:
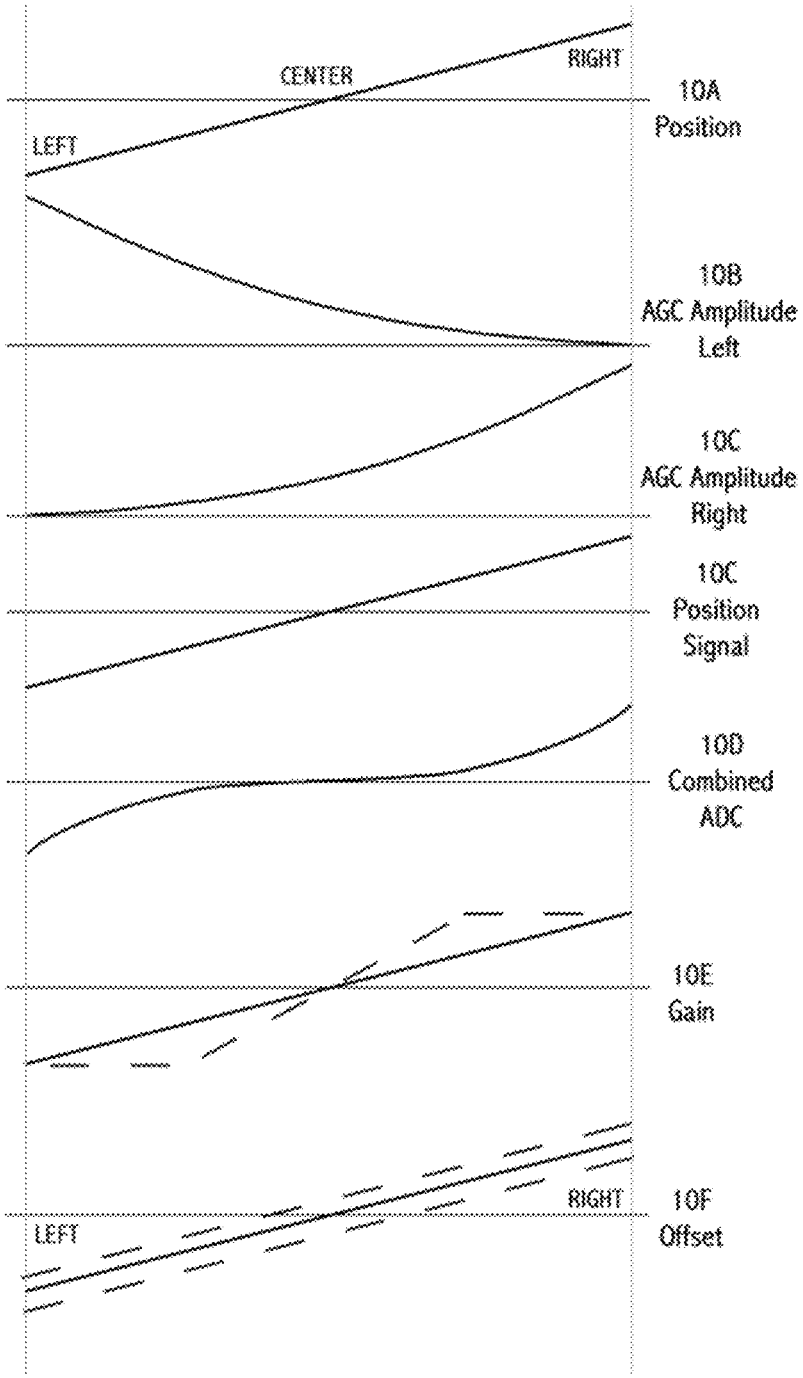
FIG. 10A through 10F shows signal amplitudes for various signals relative to position.

FIG. 10 shows various signal amplitudes for an exemplary embodiment of the circuit of FIG. 9. As will be discussed, there is considerable variation in these signal representations in implementation or embodiment. FIG. 10B and FIG. 10C show possible non-linear shapes of the signal strength outputs of signals 84 and 82 from FIG. 9 respectively. FIG. 10C shows one typical desired output signal 61 from the ratio and shaping module 83 of FIG. 9. This signal now varies linearly with position. There are many possible ways to derive a useful and desired position signal from the two carrier signal strength signals 84 and 82, as one trained in the art will appreciate.

In FIG. 10 the linear position signal 61 goes to the two variable gain amplifiers (VGAs) 64 and 65 to produce the left and right audio output signals, from the monaural audio signal 59, as previously described. The linear position signal 61 is logically inverted to produce a reverse position signal 63 prior to going to VGA 65. The square root functions previously discussed may or may not be needed. They are not shown in this figure, by may be assumed to be included either in the shaping module 83 (in which case signal 61 is not linear) or in the VGAs 64 and 65.

One or more power sources, 69, provide power to these components.

As before, the designations, "left" and "right" are arbitrary. Note that more than two audio channels may be output if more than a single scalar position signal 61 is available. Note that as before, any or all or any combination of signals may be analog or digital.

FIG. 10 may be used to help understand the relationship of various signals discussed herein, as well as the feature of "gain" and "offset." The horizontal axis for FIGS. 10A through 10F is position, measured from an arbitrary first position on the left side of the figure to an arbitrary second position on the right side of the figure. It may be helpful to visualize these positions as the left side of a performance stage and the right side of a performance stage, however no such designations or specificity are required. FIG. 10A shows the idealized linear position in arbitrary Y-axis linear measure units, with the center point, equidistant between the two end points, marked with a center rule. The ideal goal of this invention, when used in a performance environment, is to create for one or more listeners, the "audience," the perception that the source of the sound is at the actual source of the sound, with suitable corrections for remote performances in space or time, and also making any necessary corrections for virtualizations at any point in the presentation, such as the use of video projections for the performer, or headphones for the listener. Thus, FIG. 10A may also be viewed as the "ideal" perception of a listener regarding the source of the sound.

FIG. 10B shows one possible shape of a carrier signal amplitude curve from a first receiver where the Y-axis is arbitrary units such as volts. Note that this curve is non-linear. However, the shape of the curve may vary substantially from the exemplary shape shown here. FIG. 10C shows a similar but reversed carrier signal amplitude curve from the other receiver. The two receivers would be placed, typically, as discussed above for FIG. 9. FIG. 10C shows the ideal linear position signal, which ideally is similar in shape to FIG. 10A. The Y-axis for 10C is in arbitrary units, such as volts. FIG. 10D shows one possible shape that comes from a direct ratio of the two carrier strength signals from the two receivers. This particular S-shape curve could have other shapes with significantly different points of inflection. The key point is that direction combination, by ratio, sums or products, of the two carrier strength signals from the two receivers is likely to produce a non-linear curve. The most basic method of appropriately combining the two carrier signal amplitudes is to the signal shown in 10C by the inverse of the signal shone in 10B. Linearization could be done on the inputs, outputs, or both. Note that we have shown both 10B and 10C as positive above a rule baseline, where the baseline might represent a zero signal or a minimum usable carrier signal strength. When we speak of "inverting" the signal shown in 10B we refer to inversion about a middle point above the baseline. We have described a ratio and shaping module 83 in FIG. 9 to produce a linear position output that reasonably reflects shape 10C. Those trained in the art will understand and appreciate appropriate well-known circuit elements to accomplish this, based in the specifics of implementation.

FIG. 10E shows the effect of a gain control. Neutral gain is shown by the solid line in 10E. "Higher" gain is shown by the dotted line. The vertical Y-axis in this figure is perceived position, where the horizontal axis, as before, is actual position. Thus, for a higher gain setting, note that a smaller actual movement left or right of center, produces a larger apparent position shift, up the end points of the perceivable positions as far left, shown by the straight portion of the dotted line on the bottom extreme of the figure and the perceived position of far right shown as the horizontal section of the dotted line at the upper extreme in the figure. Central position is shown with a rule.

Table 2 below shows one possible implementation of a gain control. A gain setting of zero is neutral.

TABLE 2

Use of a Gain Control.

| Gain Setting | Left Distance as Percent | Right Distance as Percent | Ratio of Left/Right Distances | Ratio After Gain Adj. |
|---|---|---|---|---|
| −1.00 | 30% | 70% | 0.43 | 0.00 |
| −1.00 | 40% | 60% | 0.67 | 0.00 |
| −1.00 | 50% | 50% | 1.00 | 0.00 |
| −1.00 | 60% | 40% | 1.50 | 0.00 |
| −1.00 | 70% | 30% | 2.33 | 0.00 |
| 0.00 | 30% | 70% | 0.43 | 0.00 |
| 0.00 | 40% | 60% | 0.67 | 0.00 |
| 0.00 | 50% | 50% | 1.00 | 0.00 |
| 0.00 | 60% | 40% | 1.50 | 0.00 |
| 0.00 | 70% | 30% | 2.33 | 0.00 |
| 1.00 | 30% | 70% | 0.43 | 0.00 |
| 1.00 | 40% | 60% | 0.67 | 0.00 |
| 1.00 | 50% | 50% | 1.00 | 0.00 |
| 1.00 | 60% | 40% | 1.50 | 0.00 |
| 1.00 | 70% | 30% | 2.33 | 0.00 |

FIG. 10F shows the effect of an offset control. The axes and rule are the same as for FIG. 10E, with the Y-axis being perceived position. The solid diagonal line shows "no offset." The dotted line above the solid line represents "shift right" and the dotted line below the solid line represents "shift left," where these terms refer to the shift from the actual position to the perceived position.

The Table 3 below shows one possible implementation of an offset control. An offset setting of zero is neutral.

TABLE 3

Use of an Offset Control

| Offset Setting | First Speaker Amplitude | Second Speaker Amplitude | Ratio First/Second Amplitude | Sum of First + Second Amplitude |
|---|---|---|---|---|
| −4.00 | 9.00 | 1.00 | 9.00 | 10.00 |
| −3.00 | 8.00 | 2.00 | 4.00 | 10.00 |
| −2.00 | 7.00 | 3.00 | 2.33 | 10.00 |
| 1.00 | 6.00 | 4.00 | 1.50 | 10.00 |
| 0.00 | 5.00 | 5.00 | 1.00 | 10.00 |
| 1.00 | 4.00 | 6.00 | 0.67 | 10.00 |
| 2.00 | 3.00 | 7.00 | 0.43 | 10.00 |
| 3.00 | 2.00 | 8.00 | 0.25 | 10.00 |
| 4.00 | 1.00 | 9.00 | 0.11 | 10.00 |

Both gain and offset, if implemented, are meant to be variable controls.

Note again, that "left" and "right" are arbitrary.

Figure 11:
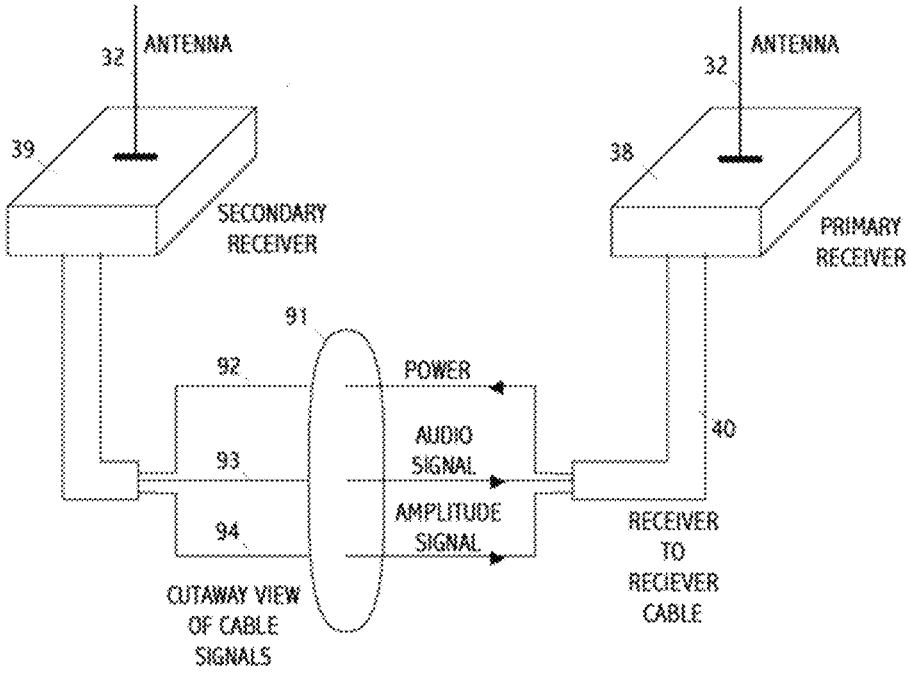
FIG. 11 shows signals within the receiver-to-receiver cable.

FIG. 11 shows one embodiment of a communication cable between a primary and a secondary receiver. This figure shows one secondary receiver, but there could be more than one. Each receiver has an antenna 32 which receivers a carrier signal from a wireless microphone. In this embodiment the primary receiver 38 is connected to the secondary receiver 39 through a cable 40. Receiver 38 provides power 92 for receiver 39 over this cable. Receiver 39 provides both an audio channel 93 and a carrier amplitude signal 94 over this cable. Many other configurations for other embodiments are possible. 91 shows that in a preferred embodiment the multiple signals between the two receivers are placed into one physical cable.

Figure 12:
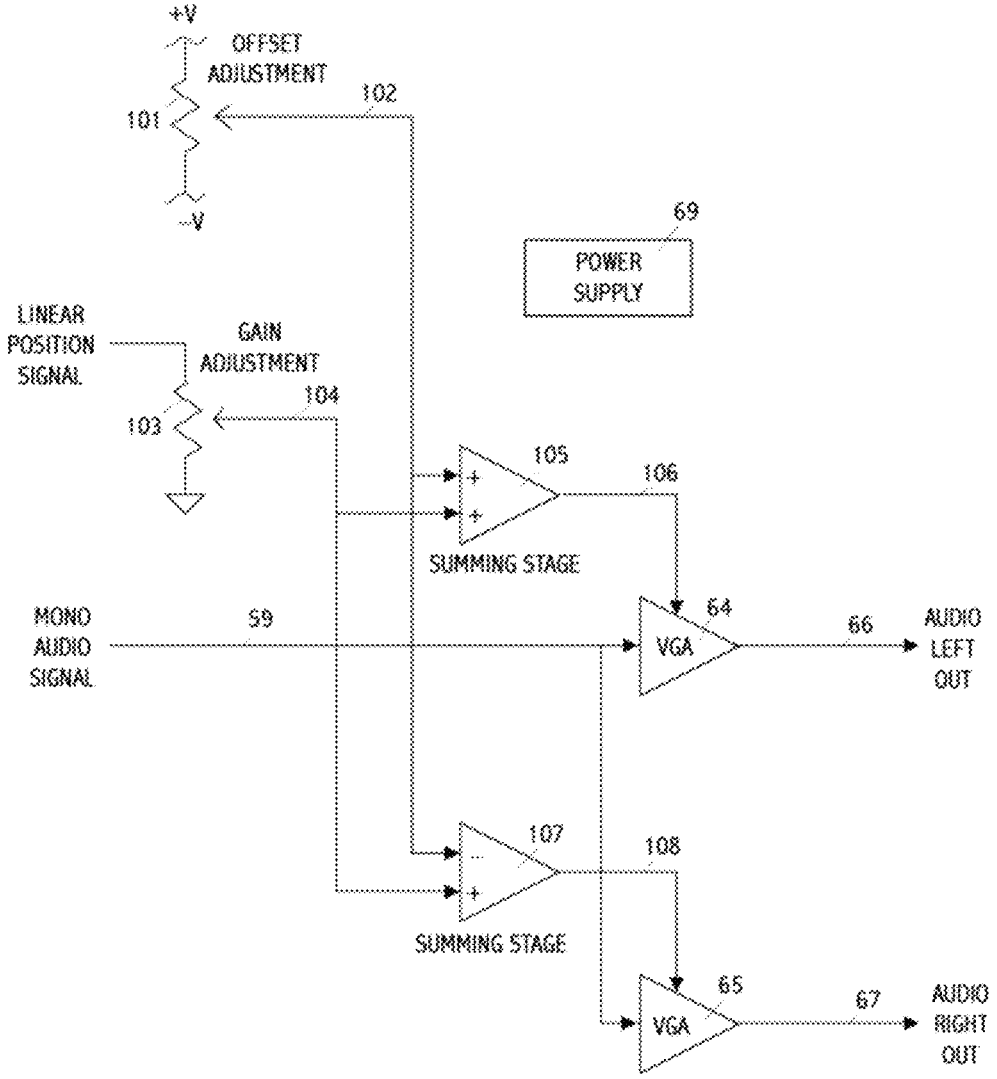
FIG. 12 shows gain and offset controls.

FIG. 12 shows one possible implementation of the features of gain and offset for embodiments that use one or both of these features. Gain changes the "amplification" of the actual position to the perceived position. For example, a neutral gain would produce one meter of perceived position shift for each one meter of actual position change. A higher gain would produce more than one meter away from the central point of perceived position change for each meter of actual position change. Such a feature could be used, for example, to exaggerate a limited range of movement of a performer into a wider apparent range of movement. Another reason to use this gain feature might be if the receivers are positioned farther than the limits of the usable stage, for example. The offset feature shifts the apparent position towards one side or the other, for a fixed actual position. This feature could be used, for example, if the receivers are not located symmetrically at the sides of the performance area. FIGS. 10E and 10F shows graphically the effect of these two features.

In FIG. 12, 101 is the variable control for offset and 103 is the variable control for gain. The controls need not be continuous and they need not be implemented as potentiometers. 101 is shown with a bipolar signal whose range is +V to −V. 102 is shown as a unipolar control whose range is from zero to some arbitrary maximum value. The offset signal 102 is added to the position signal for the first channel while being subtracted from the position signal for the second channel, as shown by the input signs on the summation stages 105 and 107 respectively. The gain signal 104 is added to the position signals for both channels, as shown by the input signs on the summation stages 105 and 107. The outputs 106 and 108 of these two summation stages go to the previously described VGAs 64 and 65. The two signals 106 and 108 are not the same signals as 61 and 63, however 61 can be combined with 106 and 63 can be combined with 108 either in the summation stages 105 and 107 shown here, or in another summation stage, or internally in the VGAs 64 and 65. Such separate combination of signals does not need to be shown in this figure as these techniques are well known in the art. The effects of the gain and offset adjustments 101 and 103 change the amplitudes of the outputs 66 and 67 of the VGAs to implement the described effects.

There are many other possible ways to implement the features of gain and offset, as those trained in the art will appreciate. All signals may be either analog or digital. The controls may be continuous or discreet. The controls may be mechanical or electronic. They may be implemented via icons or other human input means from an electronic interface device.

Figure 13:
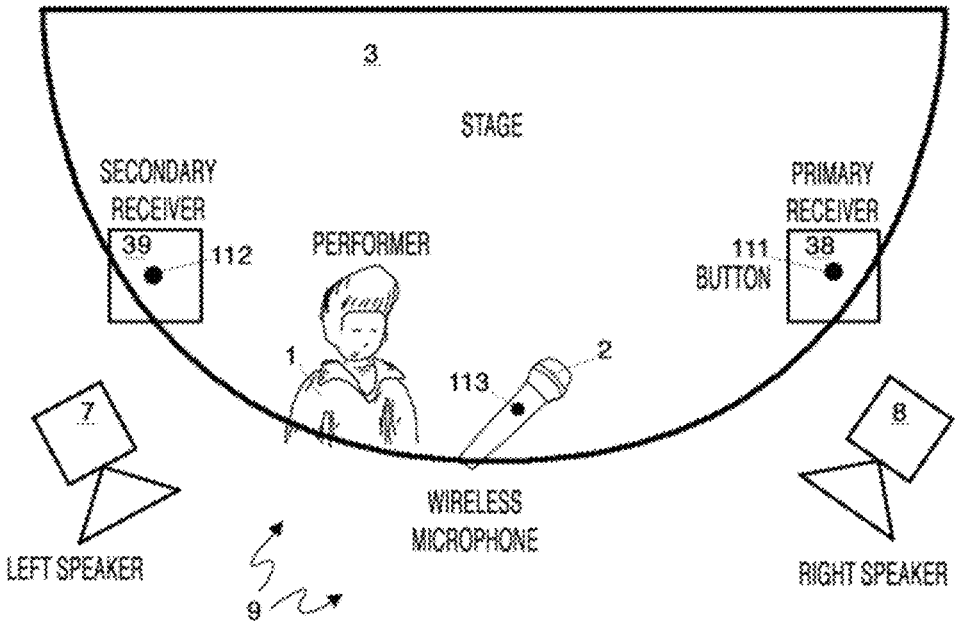
FIG. 13 shows calibration buttons.

FIG. 13 shows the use of one or more calibration buttons in an exemplary system implementation for one embodiment. See also the description and definition below for "switch" and "calibration." In a performance area 9 there is a performer 1 and a wireless microphone 2 on a stage 4. Near the sides of the stage are a left speaker 7 and a right speaker 8. This particular embodiment uses two receivers, 38 and 39 located near the right and left sides of the stage respectively. Three calibration buttons 111, 112, and 113 are shown. Note that effective calibration, in some embodiments may be also be accomplished with one or two buttons. Note also that for more than two channels of output from the invention, that additional calibration points or buttons may be appropriate. In a preferred embodiment, all buttons are momentary. Button 111 is located on the primary receiver 38, located near the right side of the stage. Pressing this button indicates that the wireless microphone is at the right side of the stage. Button 112 is located on the secondary receiver 39, located near the left side of the stage. Pressing this button indicates that the wireless microphone is at the left side of the stage. Button 113 located on the wireless microphone. Pressing this button indicates that the wireless microphone is at the center of the stage. In an alternative embodiment all three buttons are located on the wireless microphone. In such an embodiment the performer may easily and quickly perform the calibration himself or herself. Note that although in many embodiments of this invention no change to the wireless microphones of the prior art is necessary, adding calibration buttons to the wireless microphone is an improvement over prior art.

There are many methods of communicating calibration or button activation information from the wireless microphone. For example, a sub-audio tone, such as below 20 Hz, could be used, with different frequencies, burst lengths or patterns for different buttons. Alternatively, a super-audio tone, such as above 20,000 Hz, could be used. Alternatively, the carrier could be turned of a period of time. As one trained in the art appreciates, there are many other methods for communicating calibration or button activation information from the wireless microphone.

Figure 14:
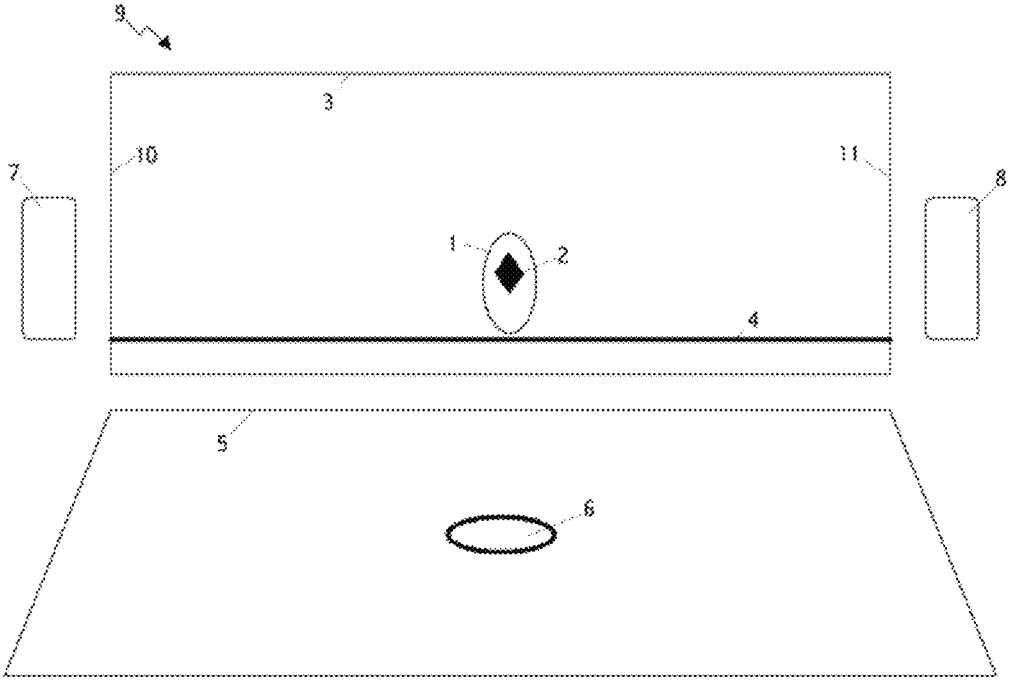
FIG. 14 shows another view of the system in performing and listening areas.

FIG. 14 shows a basic embodiment of the invention. A device of the invention 121 takes as input a single audio channel 122 and at least one position input signal 123. As output it produces at least two channels of audio output, arbitrarily identified in this figure as a left channel and a right channel. Each of the channels comprises primarily the input audio 122 information, with the amplitude of the two or more outputs responsive to the position signal 123.

Figure 15:
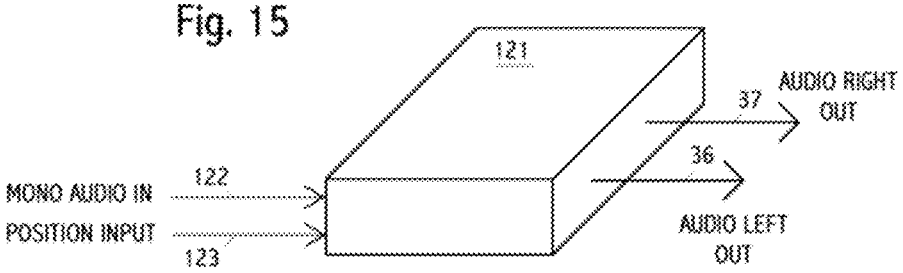
FIG. 15 shows an embodiment that uses position input from another source.

FIG. 15 shows another embodiment of the invention, whereby a device of this invention 121, which maybe called a splitter and may be incorporated into another device such as a wireless microphone receiver or a mixer, accepts one channel of audio input 122 and one channel of position input 123 and produces two channels of audio output 36 and 37 which may be called left channel and right channel, respectively. In typical use the average volume of the two outputs is approximately equal to the input volume. When the position input is at a midpoint value, the two audio outputs have the same volume. As the position input changes from a minimum value to a maximum value one of the two outputs also changes from a minimum to a maximum value. Similarly, as the position input changes from a minimum to a maximum value the other of the two outputs changes from a maximum to a minimum value. Not shown in this figure, but described elsewhere, is the optional use of position offset and gain controls. Not shown in this figure but described elsewhere is the optional use of calibration inputs.

Figure 16:
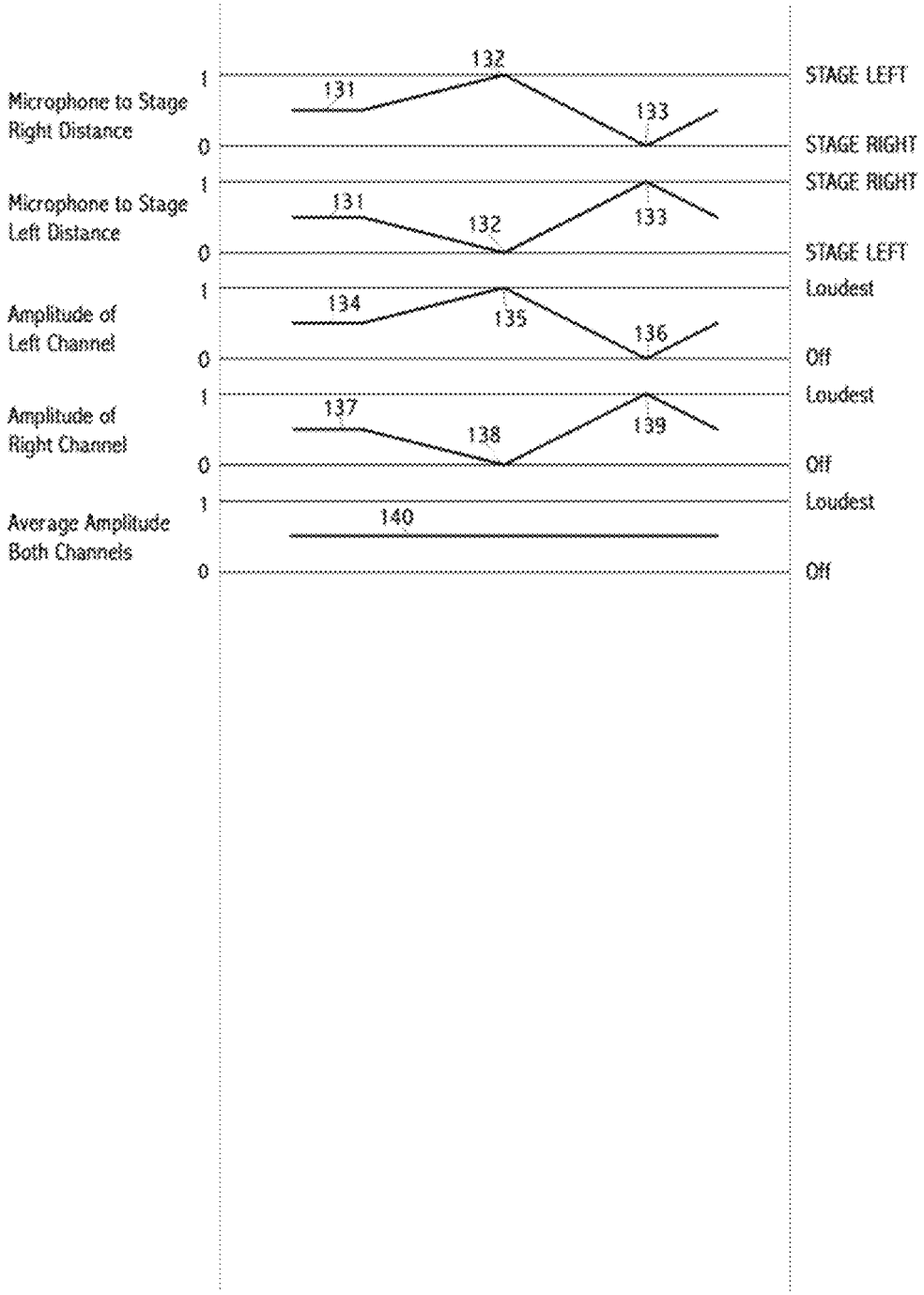
FIG. 16 shows the relationship between position on a stage and the volume of two channels.

FIG. 16 shows the relative relationships of the microphone position on a stage and the volume of two channels of output. Other embodiments may use additional axes and possibly additional speaker channels. FIG. 16 shows five graphs. The first two graphs show the distance of the wireless microphone, or in other embodiments a performer, from the two sides of the stage. The next two graphs show the corresponding amplitude of two audio channels. The position of the microphone or performer may be viewed as input to this invention and the two amplitudes may be viewed as outputs of this invention. The final graph shows how the average amplitude of the two output channels stays relatively constant. Location 131 has the microphone in the approximate center of the stage. 131 shows the microphone at stage left, which may be referred to as a first position. 133 shows the microphone at stage right, which may be referred to as a second position. The lines from 131 to 132 and 133 may be viewed as the microphone and/or performer moving across the stage. 134 and 137 show respectively the amplitudes of the left and right channels being approximately equal, so that the perceived location of the performer is near stage center. 135 shows the amplitude of the left channel peaking as the performer moves to the left side of the stage, while 138 shows the right channel diminishing in volume at the same time. 139 shows the amplitude of the right channel peaking as the microphone moves to the right side of the stage, while 136 shows the left channel respectively diminishing in volume. 140 shows how the average amplitude for both channels stays relatively constant independent of the position of the microphone or performer. These graphs assume approximately constant source amplitude. If the performer were a singer, for example, all amplitudes would change in correspondence with the singer's volume, as in a normal audio performance in the prior art.

Let us now use some equations to define one embodiment of this invention. A performance space is defined with a first position P1 we also refer to as left and a second position P2 we refer to as right. A sound source, such a wireless microphone or a performer is at physically at position PS located on a line between P1 and P2. We also call the sound source the performer. The distance from P1 to PS is D1. The distance from PS to P2 is D2. The distance from P1 to P1 is DS. D1+D2=DS. A left speaker is on the left side of the performance area near P1. A right speaker is on the right side of the performance area near P1. We define the amplitude of the sound from the left speaker as A(L) and the amplitude of the sound from the right speaker as A(R). For a constant perceived amplitude of sound for a listener who can hear both speakers, as the apparent sound source varies between left and right, we want A(L)+A(R)=A(C), where A(C) is a constant. In one embodiment A(L)=k1*D2 and A(R)=k2*D1; k1 and k2 are constants that convert units of distance to units of amplitude. In a preferred embodiment, k1=k2. The amplitudes, such as A(L) and A(R) may be power, voltage, dB, sound pressure, or some other appropriate measure of perceived audio amplitude.

Let us now use some different equations to define a second embodiment of this invention. A performance space is defined with a first position P1 we also refer to as left and a second position P2 we refer to as right. A sound source, such a wireless microphone or a performer is at physically at position PS located on a line between P1 and P2. We also call the sound source the performer. The distance from P1 to PS is D1. The distance from PS to P2 is D2. The distance from P1 to P1 is DS. D1+D2=DS. A left speaker is on the left side of the performance area near P1. A right speaker is on the right side of the performance area near P1. We define the amplitude of the sound from the left speaker as A(L) and the amplitude of the sound from the right speaker as A(R). For a constant perceived amplitude of sound for a listener who can hear both speakers, as the apparent sound source varies between left and right, we want A(L)+A(R)=A(C), where A(C) is a constant. In this second embodiment A(L)=k3/D1 and A(R)=k4/D2; k3 and k4 are constants that convert units of distance to units of amplitude. In a preferred embodiment, k3=k4. The amplitudes, such as A(L) and A(R) may be power, voltage, dB, sound pressure, or some other appropriate measure of perceived audio amplitude.

Let us now use some yet different equations to define a third embodiment of this invention. A performance space is defined with a first position P1 we also refer to as left and a second position P2 we refer to as right. A sound source, such a wireless microphone or a performer is at physically at position PS located on a line between P1 and P2. We also call the sound source the performer. The distance from P1 to PS is D1. The distance from PS to P2 is D2. The distance from P1 to P1 is DS. D1+D2=DS. A left speaker is on the left side of the performance area near P1. A right speaker is on the right side of the performance area near P1. We define the amplitude of the sound from the left speaker as A(L) and the amplitude of the sound from the right speaker as A(R). For a constant perceived amplitude of sound for a listener who can hear both speakers, as the apparent sound source varies between left and right, we want A(L)+A(R)=A(C), where A(C) is a constant. In this third embodiment A(L)=k5*D2/D1 and A(R)=k6*D1/D2; k5 and k6 are constants that convert units of distance to units of amplitude. In a preferred embodiment, k5=k6 The amplitudes, such as A(L) and A(R) may be power, voltage, dB, sound pressure, or some other appropriate measure of perceived audio amplitude.

Most discussion herein has referred to a single wireless microphone. In many performances, more than one wireless microphone is often used. Nothing in this description or claims precludes multiple instances of this invention, or multiple instances of portions of this invention to achieve position information for multiple wireless microphone or multiple performers. For example, a single receiver is often capable of receiving signals from more than one wireless microphone.

We have described embodiments using physical devices in a physical environment. This invention works equally well when some or all of the components are wholly or partially implemented digitally using software, digital electronics, digital signal processing or by other means. This invention works equally well some or all of the components are implemented in a distributed fashion.

DEFINITIONS

"Amplifier"—An amplifier is an electronic device that takes an input signal of one amplitude or format and produces an output signal of higher amplitude or different format or impedance. In audio performances, amplifiers are used in multiple locations for multiple purposes. A microphone preamplifier takes the electrical output from a microphone as input and produces a relatively "standard" voltage and impedance output, often measured in dBu or dBV, or measured in dB relative to 0.775 volts RMS. Sometimes standard audio signals are measured as power, where 0 dBm represents one milliwatt into a 600 ohm load. A peak signal maybe approximately +4 dBu or −10 dBV. One trained in the art will appreciate these units and metrics. A mixer might have both microphone inputs and "standard" inputs. It will typically produce "standard" outputs as defined above. A speaker amplifier or power amplifier takes "standard" inputs as defined above and produces signals of appropriate voltage, current, impedance and power to drive one or more speakers. Microphone preamplifiers, mixers, and power amplifiers exist in wide range of packaging and performance capabilities. An RF amplifier, such as is typically found in a wireless microphone receiver, amplifies radio frequency signals. An RF amplifier may incorporate an AGC, or the AGC may be separate from the RF amplifier.

"Audio"—An audible sound.

"Audio representation"—refers to the rendering of an electrical audio signal by a speaker, headphone, or similar device to produces sound, or to the generation of an electrical audio signal by a microphone or similar device in response to a sound. The universal goal of audio representation is fidelity, meaning the accurate conversion of the electrical signal to sound and vice versa without the introduction of any artifacts such as distortion, noise, inappropriate phase shift or inappropriate delay.

"Audio signal"—primarily amplitude, but ideally phase information is also included as part of an audio signal for the best possible audio fidelity. Signal delay may be a critical aspect of an audio signal. A single audio signal may be a low level signal of type similar to the output of a microphone, or a low level signal of type similar to traditional audio signals used within mixers and as inputs to power amplifiers, or a power signal designed to drive a speaker, or some other suitable signal containing audio information, including a wide range of digital audio signal formats, including but not limited to PCM formats, CD format, DVD format, HDMI format, MP3, Advanced Audio Coding, Ogg Vorbis, FLAC format, .wav, .mid, .ra, ram, Wma, format, aiff format, and many more, including both compressed and non-compressed, lossless and lossy formats, encrypted and non-encrypted, pure audio and audio with other information included in the format, such as video information, both file formats and streaming formats.

"Audience"—One or more listeners.

"Automatic Gain Control," or "AGC"—A circuit that accepts an input signal of wide amplitude variation and provides an output signal of relatively consistent amplitude. AGCs are used for both audio signals and for RF signals. In mode embodiment an AGC works by averaging the amplitude of an input signal and using that average to then control a variable gain amplifier (VGA), which then in turn amplifies the input signal, a variable amount. In another embodiment of an AGC the output of the VGA is averaged and then used that as a control signal for the VGA. In either embodiment the control signal to the VGA reflects the amplitude of the input signal. These and other implementations of AGC circuits are common and well known to those skilled in the art.

"Calibration"—The process of calibrating the actual position of wireless microphone or a performer to cause the invention to create an audio apparent position, or stereo image, of the microphone or performer at a present position. If a single calibration point is used, which may be set by the activation of a button, the typical implementation would assure that the one preset position is produced accurately by adjusting either the gain, offset, or both. Positions other than the one preset position may not be produced accurately. If two calibrations points are used, which may be set by activating two buttons, then these two preset positions are produced accurately, typically by adjusting both the gain and offset. If three calibration points are used, which may be set by activating three buttons, then these three preset positions are produced accurately. In one preferred embodiment for a one-button system the preset position is the center of the performance area. In one preferred embodiment for a two-button system the preset positions are the left and right of the performance area. In one preferred embodiment for a three-button system the preset positions are the left, right and center of the performance area. One trained in the art will appreciate that there are many other ways to accomplish calibration besides the use of one or more buttons. If buttons are used for calibration, one embodiment places the buttons on one receiver, two receivers, or on the wireless microphone, in any combination. Such a location or locations for the button or buttons provides convenience for the performer or the person setting up the sound for a performance. If any of the buttons are physically located at or near the preset position represented by that button, the calibration using such a button or buttons is intuitive. For example, a button located on a receiver placed at the left side of the stage could create a calibration point at the left side of the stage. A button on the wireless microphone creates a simple way to create a calibration point for the center of the performing area.

"Channel"—An audio channel generally contains one monaural signal. The term channel may refer to an end-to-end path, such as from a microphone, through a pre-amp, through a mixer, through a power amp, and then to a speaker. Or, it may refer to a single point or single path segment within a longer end-to-end channel. For example, a mixer specification normally refers to its maximum number of inputs as channels. While a channel in a professional audio context normally refers to a specific signal or specific cable or cable connection, it may also refer to group of related signals. For example, the "left channel" might actually consist of three separate channels, a high-frequency channel, a mid-frequency channel, and a low-frequency channel, all going to a related speaker set or speaker assembly that in aggregate is known as the "left speaker." Thus, for example in this invention, the modulator may produce a single standard output identified as the "left channel," which after it passes through a mixer/amplifier becomes three separate channels going to physical speakers.

"Increase" or "Decrease" in amplitude—Functions are described that have an inverse relationship such that as one function increases in value a second function decreases in value. These inverse relationships, the functions, and the increases and decreases in value are not absolute relationships with no deviation whatsoever, but rather a substantial relationship that accommodates minor, temporary, trivial, artificial, or insignificant variations from this relationship. The necessary accuracy of amplitudes is such that an ordinary listener would perceive the desired effect.

"Listeners, or audience, or audience members"—One or more listeners, when the invention is in use, has the perception as to the location of the sound between two speakers or speaker systems, or in an area bounded by multiple speakers or speaker systems.

"Mixer"—A mixer is a common professional audio component. A mixer typically takes as in put a large number of discreet channels and provides a smaller number of outputs, where generally, each output is intended for specific speaker after first passing from the mixer through a power amplifier. Mixers often include optional microphone pre-amplifiers. Mixers usually have volume controls, or "gain" controls for most input and output channels. Mixers may optionally have many other features, such as amplitude meters or setup memory.

"On the stage"—includes a traditional stage, position being primarily as single vector incorporating information towards stage left or towards stage right. However, the term "on the stage" could also include X-Y coordinates to indicate also position towards the back of the stage versus position towards the front of the stage. In addition, the term "on the stage" explicitly includes off the stage positions, such as off stage left, off-stage right, back stage, or in the audience. In addition, the phrase include three-dimensional information such as up in the air or beneath the stage. A stage may be any performance arena, including a sports field, or a virtual area.

"Performer"—user of the wireless microphone. Typically, a single person, who may be singing or talking or playing a musical instrument. However, the performer could be more than one person or more than one instrument. The performer is anyone or anything that produces the primary sound picked up by the wireless microphone. A performer may be an animal.

"Position or location on the stage"—this includes the position of the performer on the stage relative to stage left or stage right, but also includes positions completely off the stage, including offstage left or offstage right, and in the audience, or behind the stage. It could include three-dimensional information such as performers in the air. Such 3D positioning could be particularly appropriate for certain stage products as musicals, circuses, acrobatics, aeronautics, military productions or magic shows.

"Speakers"—Speaker are audio component that take an electrical audio signal as input and generate sound to correspond to the audio signal. Most speakers are designed to operate in the range of human audible frequencies, however, some speakers, such as sub-woofers and ultra-sonic transducers are able to operate outsider this frequency range.

"Splitter"—A generic term for a device that takes one audio input and produces two or more audio outputs.

"Stage"—The stage may be a physical stage, with a performer and a wireless microphone on the stage, with an audience in front of the stage, or it may be any space defined to contain a line between two points or a plane with more than two points on which a wireless microphone may be located.

"Stereo imaging"—the impression a listener has about the apparent physical location of the sound source, as create the outputs of two or more fixed-location speakers.

"Stereo, two channels, or left and right channels"—This is the traditional audio configuration designed to produce an apparent audio position of sound sources along a one-dimensional line stretches approximately from the left speaker location to the right speaker location. For many audio performances, the left and right speakers are located close to the stage left and stage right position, so that the possible physical range for performers on the stage proper is close to the range for the apparent audio position from these speakers.

"Switch"—A device which may be activated by a person, such as a mechanical button, which has two or more discreet states. For a two state device, the states may be identified as on or off. For a two-state switch which automatically returns to its first state, the switch may be identified as a momentary switch. The switch may be mechanical, electronic, or an icon or other input means on a human interface device. For examples, the switch may be a soft button on the touch-screen of a portable electronic device, or it could be a mechanical push button on a wireless microphone receiver.

"Wireless microphone"—A monaural or stereo audio component, with an audio sensor, that transmits the audio information received by the sensor to a separate, associated receiver without the use of a connecting wire between the microphone and receiver. The wireless microphone and the associated receiver may use radio waves or light waves as a transmission medium. The term, microphone, usually refers only to the portable component with the audio sensor. However, wireless microphones are usually sold as a system containing one or more wireless microphones with one or more matching receivers. The microphone component is commonly handheld, however it may be adapted for use as a headset or it may be clipped on an article of clothing, or it may be attached to or integrated into a musical instrument. Other mountings and applications are common. For the wireless microphone to be used as part of a full audio system both the microphone component and the associated receiver component as usually used together.

I claim:

1. A system with a wireless microphone transmitting a microphone audio signal wherein:

the wireless microphone is in a microphone physical location between a first point and a second point;

a listener is within hearing range of a first speaker at a first speaker location providing a first speaker audio output and within hearing range of a second speaker at a second speaker location providing a second speaker audio output;

the audio outputs of the first and second speakers comprise an audio output represented by the microphone audio signal;

the amplitudes of the first speaker audio output and the second speaker audio output are varied in proportion to each other such that the listener has a perception of the location of an audio source at a perceived audio source point located between the first speaker and the second speaker and the perceived audio source point location is approximately the same proportion of distance from the first speaker location to the second speaker location as the proportion of distance the microphone physical location is from the first point to the second point;

wherein the amplitude of a wireless audio signal, as broadcast by the wireless microphone, is used to detect the physical location between the first point and the second point.

2. The system of claim 1 wherein:

the first speaker location is proximal to the first point and the second speaker location is proximal to the second point.

3. The system of claim 1 wherein a receiver module provides the first speaker audio output and the second speaker audio output and wherein the receiver module also receives and demodulates the wireless audio signal from the wireless microphone.

4. The system of claim 3 wherein the splitter and the receiver module are collocated in the same container.

5. The system of claim 3 wherein:

the receiver module contains an automatic RF gain control (RF AGC) and the RF AGC comprises a variable gain amplifier and the variable gain amplifier comprises a gain control input signal;

the position signal from the receiver module is derived from the control gain control input signal.

6. The system of claim 1 further comprising:

a position gain adjustment wherein increasing this adjustment increases the ratio formed by creating a numerator consisting of the ratio of the first amplitude of the speaker audio output and the amplitude of the second speaker audio output, then dividing this numerator by a denominator consisting of the ratio of the proportion of distance the microphone physical location is from the second point and the distance the first point is to the microphone physical location; and wherein:

decreasing the position gain adjustment similarly reduces the ratio formed by the numerator and denominator.

7. The system of claim 1 further comprising:

an offset adjustment wherein increasing the offset adjustment increases the ratio of amplitude of the second speaker audio output to the amplitude of the first speaker audio output; and decreasing the offset adjustment decreases the ratio of amplitude of the second speaker audio output to the amplitude of the first speaker audio output.

8. A splitter adapted to produce a perceived audio source point location located between a first speaker and a second speaker and the perceived audio source point location is approximately the same proportion of distance from the first speaker location to the second speaker location as the proportion of distance a wireless microphone physical location is from a first point to a second point; wherein the splitter comprises:

an audio input adapted to accept a monaural audio signal from the wireless microphone;

a position input created solely within the processing circuitry of a radio frequency portion of the wireless microphone receiver;

a first splitter audio output containing the audio signal representing the audio output from the first speaker;

a second splitter audio output containing the audio signal representing the audio output from the second speaker;

the amplitudes of the first and second splitter audio outputs are responsive to the position input signal.

9. A method for providing a perceived location of a wireless microphone comprising:

(a) providing a wireless microphone transmitting a microphone audio signal wherein the wireless microphone is in a microphone physical location between a first point and a second point;

(b) providing a listener who is within hearing range of a first speaker at a first speaker location providing a first speaker audio output and within hearing range of a second speaker at a second speaker location providing a second speaker audio output and whereby the audio outputs of the first and second speakers are substantially the audio represented by the microphone audio signal;

(c) setting the average amplitude of the first and second speaker audio outputs to a desired average perceived volume level;

(d) varying the amplitudes of the first speaker audio output and the second speaker audio output in proportion to each other such that the listener has a perception of the location of an audio source at a perceived audio source point located between the first speaker and the second speaker and the perceived audio source point location is approximately the same proportion of distance from the first speaker location to the second speaker location as the proportion of distance the microphone physical location is from the first point to the second point;

wherein the varying the amplitudes in step (d) is solely in response to a position signal created solely within the processing circuitry of a radio frequency (RF) portion of an RF receiver of the wireless microphone.

10. The method of claim 9 further comprising the additional step of:

determining the proportion of distance the microphone physical location is from the first point to the second point, where this step is performed prior to step (d).

11. A method for providing a perceived location of a performer comprising:

(a) determining the proportion of distance the performer is from a first point to a second point;

(b) playing a recording containing at least a first channel of audio and a second channel of audio;

(c) playing the first channel of audio through a first speaker at a first speaker location and the second channel of audio through a second speaker at a second speaker location and setting the average amplitude of the first and second speaker audio outputs to a desired average perceived volume level;

(d) varying the amplitudes of the first speaker audio output and the second speaker audio output in proportion to each other such that a listener has a perception of the location of an audio source at a perceived audio source point located between the first speaker and the second speaker and the perceived audio source point location is approximately the same proportion of distance from the first speaker location to the second speaker location as the proportion of distance the performer is from the first point to the second point;

wherein the varying the amplitudes in step (d) is solely in response to a position signal created solely within the processing circuitry of a radio frequency (RF) portion of an RF receiver of the wireless microphone;

thereby providing the listener with the perception that the audio source point is approximately the same location as the performer.

12. A device comprising:

a wireless microphone transmitting a carrier signal modulated by an input audio signal;

a first and a second wireless microphone receiver;

a receiver communication channel comprising one or more signals from the second receiver to the first receiver;

the first and second receivers each comprise a carrier signal detector wherein each carrier signal detector provides a first and second carrier amplitude signal responsive to the amplitude of the carrier signal received by the first and second receivers respectively;

at least one of the receivers comprises a demodulator to produce a receiver audio signal by demodulating the carrier signal;

a first audio output consisting of the substantially the same audio information as the receiver audio signal modified in volume by a first function of both the first and second carrier amplitude signals;

a second audio output consisting of substantially the same audio information as the receiver audio signal modified in volume by a second function of both the first and second carrier amplitude signals;

the first and second functions having an inverse relationship such that as the value of the first function increases the value of the second function decreases;

the first function increases in value as the first carrier amplitude signal decreases and decreases in value as the value of the second carrier amplitude signal decreases;

the second function decreases in value as the first carrier amplitude signal decreases and increases in value as the value of the second carrier amplitude signal decreases.

13. A device comprising:

a first radio frequency (RF) receiver adapted to receive a first RF modulated signal transmitted from a first monaural wireless microphone;

circuitry to generate a first RF carrier signal amplitude from the first RF modulated signal;

an input for a remote signal comprising a second RF carrier amplitude from a second RF receiver adapted to receive a second RF modulated signal transmitted from the first monaural wireless microphone; and the second RF receiver is located remote from the first RF receiver;

circuitry to generate a first position signal solely in response to the first RF carrier amplitude and the second RF carrier amplitude;

two or more audio outputs each containing one channel of audio information wherein:

a first audio output consisting of the same audio information as a first audio amplitude from the first monaural wireless microphone modified in volume by a first function of the first position signal;

a second audio output consisting of the same audio information as the first audio amplitude from the first monaural wireless microphone modified in volume by a second function of the first position signal;

the first and second functions having an inverse relationship such that as the value of the first function increases as the value of the second function decreases; and optionally also from a location gain control, and optionally also from a location offset control.

14. The device of claim 13 wherein the first position signal comprises a position of the first monaural wireless microphone.

15. The device of claim 13 wherein the position signal varies from a first position value to a second position value.

16. The device of claim 15 additionally comprising:

a quantity n where n is one or more switches wherein each switch, when activated, defines the current value of the position signal to represent a preset position; and wherein when one of the n switches, when activated, defines the current value of the position signal to represent a position equidistant between a first position and a second position;

wherein the first position and the second position correspond to the first position value and the second position value, respectively.

17. The device of claim 15 additionally comprising:

a quantity n where n is one or more switches wherein each switch, when activated, defines the current value of the position signal to represent a preset position; and wherein when one of the n switches, when activated, defines the current value of the position signal to represent the first position.

18. The device of claim 13 wherein:

the volume modification of the first audio output by the first function of the position signal comprises multiplying the first audio amplitude by the value of the first function;

the volume modification of the second audio output by the second function of the position signal comprises multiplying the first audio amplitude by the value of the second function.

19. The device of claim 13 wherein:

the position signal varies from a minimum position value to a maximum position value;

the first function has the maximum position value when the position value is at its minimum value and the first function has the minimum position value when the position value is at its maximum value;

the second function has the minimum position value when the position value is at its minimum value and the second function has the maximum value when the position value is at its maximum value.

20. The device of claim 19 wherein:

the first and second functions are at a midpoint value between their minimum and maximum values when then the position signal is at a midpoint between the position signal's minimum and maximum value.

21. The device of claim 19 wherein:

the modification of the first audio output by the first function of the position signal comprises multiplying the first audio amplitude by the value of the first function;

the modification of the second audio output by the second function of the position signal comprises multiplying the first audio amplitude by the value of the first function;

the sum of the square root of the first function and the square root of the second function is a constant.

22. The device of claim 13 wherein at least one of the audio output channels comprises a time delay from the input channel.

23. The device of claim 22 wherein the time delay is a function of the position signal.

24. The device of claim 13 wherein at least one of the functions comprises a time delay which is a function of the position signal.

25. The device of claim 13 wherein the position signal corresponds to the position of a performer.

26. The device of claim 13 additionally comprising:

a quantity n where n is one or more switches wherein each switch, when activated, defines the current value of the position signal to represent a preset position.

27. The device of claim 26 wherein at least one of the n switches is physically located proximal to the preset position so defined by activating the switch.

28. A device comprising:

a wireless microphone transmitting a carrier signal modulated by an input audio signal; and the device of claim 13 wherein the first and second RF receivers are adapted to receive the carrier signal.

* * * * *